US007108963B1

(12) United States Patent
Mura, Jr. et al.

(10) Patent No.: US 7,108,963 B1
(45) Date of Patent: Sep. 19, 2006

(54) STABILIZED SILVER HALIDE PHOTOGRAPHIC ELEMENT

(75) Inventors: Albert J. Mura, Jr., Rochester, NY (US); Gary M. Russo, Webster, NY (US); Shari L. Eiff, Rush, NY (US); Brian Thomas, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/100,126

(22) Filed: Apr. 6, 2005

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/502; 430/543; 430/546; 430/551; 430/556; 430/557

(58) Field of Classification Search ..... 430/543, 430/546, 551, 556, 557, 502
See application file for complete search history.

(56) References Cited

U.S. PATENT DOCUMENTS

| | | | | |
|---|---|---|---|---|
| 6,071,686 | A * | 6/2000 | Cowan et al. | 430/558 |
| 6,846,620 | B1 | 1/2005 | Mura, Jr. et al. | |

* cited by examiner

*Primary Examiner*—Geraldine Letscher
(74) *Attorney, Agent, or Firm*—Arthur E. Kluegel

(57) ABSTRACT

A photographic element comprises a silver halide emulsion layer having associated therewith a dye forming coupler and a combination of a carbonamide compound, a phenolic compound, and an electron-rich compound. Such a combination provides improved dye stability.

17 Claims, No Drawings

STABILIZED SILVER HALIDE PHOTOGRAPHIC ELEMENT

FIELD OF INVENTION

This invention relates to silver halide color photographic materials. More particularly, it relates to color photographic materials which contain dye-forming couplers together with non-imaging compounds, which function as coupler solvents and stabilizers, a combination of which gives rise to photographic images providing high stability towards fading by light.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer reacts with one or more incorporated dye-forming couplers to form an imagewise distribution of dye. Dye-forming couplers (as well as other various photographic addenda) are typically dispersed in silver halide emulsion layers of the photographic element with the aid of coupler solvents, which are typically oily or low melting compounds.

In any polychromatic chromogenic photographic material, it is desirable that the dyes so formed should have certain properties. For instance, the dyes should be bright in color with very little secondary absorption so that good color reproducibility is obtained. The expectations include resistance to light fade and both humid and dry heat dark fade. The dyes that are formed by any color coupler during processing have a tendency to fade over time as a result of exposure to light, heat, humidity and oxygen resulting in a deterioration of the original recorded image. It is, therefore, highly desirable that the formed dyes should be more resistant towards fading by heat, humidity and light.

Techniques are known in the art for providing resistance to light fade of photographic dyes. Unfortunately, these techniques have not been completely successful resulting in the development of many unique stabilizing chemistries. Compounds which have been disclosed as light stabilizers for yellow image dyes, e.g., include substituted phenolic and blocked phenolic compounds including; heterocyclic phosphorous materials (U.S. Pat. No. 4,749,645), phenolic thiane derivatives (EP 0 310 551), substituted and blocked bisphenols (UK 1,267,287, U.S. Pat. No. 4,782,011, DE 4,307,439, DE 4,307,439, DE 4,320,828, EP 0 508 398, EP 0 538 862, U.S. Pat. No. 5,294,530, U.S. Pat. No. 5,426,021, U.S. Pat. No. 5,441,855, U.S. Pat. No. 5,441,861, U.S. Pat. No. 5,466,569, U.S. Pat. No. 5,891,613, WO 91/008,515, U.S. Pat. No. 5,567,578, U.S. Pat. Nos. 5,284,742, 5,091,294, EP 0 310 552, U.S. Pat. No. 5,935,773). In addition, yellow dyes may also be stabilized against fading by light with the use of thiomorpholine dioxide compounds as described in U.S. Pat. No. 4,933,271,U.S. Pat. No. 5,091,294, U.S. Pat. No. 5,006,665 and U.S. Pat. No. 6,312,881.

Various yellow high boiling coupler solvents have been reported to increase light stability. German patent application DE 1 96 32927 describes the use of cyclic imides, cyclic carbamates, and cyclic ureas as a means of improving the chromogenically developed color image dye stabilities. However, in particular, the amount of dye stabilization to light fade is only modest. U.S. Pat. No. 5,352,572 reports the use of a specific bis-urea compound in combination with malonamide yellow couplers. However, the bis-urea compounds were not shown to be effective for other couplers and were specifically reported to be ineffective for beta-ketoamide yellow couplers. U.S. Pat. No. 6,045,987 describes the use of amide group substituted aromatic compounds, wherein the amide groups are directly bonded to a phenyl ring, as addenda to coupler dispersions, and in particular the use of such compounds in association with magenta and cyan dye image-forming couplers. Essentially equivalent results are reported for the use of such amide group substituted phenyl compounds regardless of whether the amide group substituents comprise normal, cyclic, or branched alkyl groups. U.S. Pat. No. 6,413,707 discloses the use of urethane based coupler solvents and U.S. Pat. No. 6,555,306 describes a substituted dipiperidine compound as a yellow coupler solvent in photographic elements to improve image dye stability. Most recently, U.S. Pat. No. 6,846,620 discloses a class of bis-amide coupler solvents that is relatively low in cost and enhances the light stability and reactivity of the formed yellow dye image.

In spite of past efforts, the coupler solvents and stabilizers developed to date still do not sufficiently improve the light stability of the dye images, especially yellow dye images.

SUMMARY OF THE INVENTION

The invention provides a photographic element comprising a silver halide emulsion layer having associated therewith a dye forming coupler and a combination of:

A. a coupler solvent compound of the following Formula I:

$$R^1R^2N—C(O)—(R)_p—C(O)—NR^3R^4 \quad (I)$$

wherein:

R represents a non-aromatic hydrocarbon-linking group;

pis 0 or 1;

$R^1$, $R^2$, $R^3$ and $R^4$ are independently selected substituent groups;

B. a phenolic antioxidant compound of Formula P:

(P)

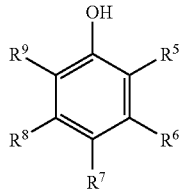

wherein:

$R^5$, $R^6$, $R^7$, $R^8$ and $R^9$ are independently hydrogen or substituent groups; and C. an electron-rich aromatic compound of Formula EA:

(EA)

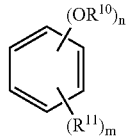

wherein:

each $R^{10}$ is a substituent group;

each $R^{11}$ is hydrogen or an independently selected substituent group; and n is 2 to 6 and m is 0 to 4; provided that the total of n+m is not larger than 6.

This combination provides an improved dye stability, especially in the case of yellow dyes.

DETAILED DESCRIPTION OF THE INVENTION

In addition to stabilizing properties, compounds of Formula I have organic solvent properties, and accordingly may be advantageously used partly or totally in place of conventional high boiling permanent and/or auxiliary organic coupler solvents to disperse the dye-forming couplers. Photographic elements of the present invention upon exposure and photographic processing exhibit increased activity and yield dye images that have unexpected and substantial improvements in the stability of the formed image dyes. A further description of the components of the invention and their appropriate usages follows.

The photographic elements of this invention can be chromogenic black and white elements (for example, using yellow, magenta and cyan dye forming couplers), single color elements or multicolor elements. In accordance with preferred embodiments of the invention, the photographic elements comprise at least one yellow dye image forming layer, at least one cyan dye image forming layer and at least one magenta dye image forming layer. More particularly, multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, non-diffusing color-forming couplers are incorporated in the light-sensitive photographic emulsion layers so that during development, they are available in the emulsion layer to react with the color developing agent that is oxidized by silver halide image development. When the dye image formed is to be used in situ, couplers are selected which form non-diffusing dyes. Color photographic systems can also be used to produce black-and-white images from non-diffusing couplers as described, e.g., by Edwards, et al., in International Publication No. WO 93/012465.

Unless otherwise specifically stated, use of the term "substituted" or "substituent" means any group or atom other than hydrogen. Unless otherwise provided, when a group, compound or formula containing a substitutable hydrogen is referred to, it is also intended to encompass not only the unsubstituted form, but also form further substituted with any substituent group or groups as herein mentioned, so long as the substituent does not destroy properties necessary for utility. Suitably, a substituent group may be halogen or may be bonded to the remainder of the molecule by an atom of carbon, silicon, oxygen, nitrogen, phosphorous, or sulfur. The substituent may be, for example, halogen, such as chloro, bromo or fluoro; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, cyclohexyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl] sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired desirable properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

Examples of the more commonly employed substituents include: halogen, for example, chloro, fluoro, bromo, iodo; alkoxy, particularly those with 1 to 6 carbon atoms (for example, methoxy, ethoxy); substituted or unsubstituted alkyl, particularly lower alkyl, for example, methyl, trifluoromethyl; alkenyl, for example, propenyl; thioalkyl, for example, methylthio or ethylthio, particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl). Alkyl substituents may specifically include "lower alkyl", that is having from 1 to 6 carbon atoms, for example, methyl, ethyl, cyclohexyl, and the like. "Higher alkyl," sometimes referred to as "ballasts" required for the above-mentioned non-diffusing dyes, typically have 7–40 carbon atoms. Further, with regard to any alkyl group, alkylene group or alkenyl group, it will be understood that these can be branched or unbranched and include ring structures.

Compounds of Formula I which are employed as dye image stabilizing compounds and/or solvents in photographic elements in combination with yellow dye forming couplers in accordance with the present invention may be prepared according to synthetic methods known in the art.

$$R^1R^2N—C(O)—(R)_p—C(O)—NR^3R^4 \quad (I)$$

Hydrocarbon linking groups represented by R may comprise, e.g., further substituted or unsubstituted cyclic, linear, or branched chain non-aromatic linking groups, and when present (i.e., when p=1) preferably comprises from 1 to 30 carbon atoms, more preferably from 6 to 22 carbon atoms. The term "non-aromatic linking group" is used in the present invention to designate the presence of a linking group R such that the $R^1R^2N$—C(O)— and the —C(O)—$NR^3R^4$ groups are not bonded directly to an aromatic ring (such as a phenyl ring). Representative examples of non-aromatic hydrocarbon linking groups include: $C_1$–$C_{30}$ alkylene, tetramethylhexane, cylcohexane, cyclohexane diethyl, dioxaoctane, p-phenylene-di-propane, and the like. In a particularly preferred embodiment, R may represent a saturated or unsaturated $C_1$–$C_{16}$ alkylene linking group. Non-aromatic hydrocarbon linking groups represented by R may be further substituted or unsubstituted, with aromatic or non-aromatic substituents, so long as the $R^1R^2N$—C(O)— and the —C(O)—$NR^3R^4$ groups are not bonded directly to an aromatic ring. In a particular embodiment, e.g., hydrocarbon linking groups represented by R may comprise one or more substituents comprising additional —C(O)—$NR^1R^2$ type amide groups.

Each of $R^1$, $R^2$, $R^3$ and $R^4$ in Formula I may comprise aromatic, cyclic, linear, or branched chained hydrocarbon groups, which may be the same or different, or $R^1$ and $R^2$ or $R^3$ and $R^4$ may combine together to form a ring with the associated nitrogen atom to which they are attached, provided (i) at least one of $R^1$, $R^2$, $R^3$ and $R^4$ comprises an aromatic, cyclic, secondary alkyl, or otherwise a branched hydrocarbon group, or (ii) at least $R^1$ and $R^2$ or $R^3$ and $R^4$ combine together to form a ring with the associated nitrogen atom (such as, e.g., a piperidine or morpholine group). In preferred embodiments, $R^3$ and $R^4$ are selected to match $R^1$ and $R^2$, as symmetrical compounds are preferred for ease of synthesis. Subject to the above proviso, each of $R^1$, $R^2$, $R^3$ and $R^4$ preferably comprises from 1 to 22 carbon atoms, more preferably from 2 to 14 carbon atoms and most preferably from 3 to 10 carbon atoms. Also preferred is that at least two, and more preferably each of $R^1$, $R^2$, $R^3$ and $R^4$, comprise cyclic, secondary, or otherwise branched chain alkyl groups, or that both $R^1$ and $R^2$ as well as $R^3$ and $R^4$ combine to form rings with their associated nitrogen atoms. Representative examples for $R^1$, $R^2$, $R^3$ and $R^4$ groups include: methyl, ethyl, propyl, iso-propyl, butyl, iso-butyl, pentyl, hexyl, ethylhexyl, octyl, nonyl, iso-nonyl, decyl, iso-decyl, undecyl, dodecyl, tridecyl, tetradecyl, myristyl, pentadecyl, cetyl, stearyl, arachidyl, behenyl, undecylenyl, palmitoleyl, oleyl, linoleyl, linolenyl, arachidonyl, erucyl, benzyl, cyclohexyl, phenoxyethyl, and phenyl. R1 and R2 or R3 and R4 may combine, e.g., to form hexamethylene, heptamethylene, pentamethylene, methylpentamethylene and dimethylpentamethylene groups, which form a ring with the associated nitrogen atom. This list is non exhaustive and may also include numerous other linear, branched chain, cyclic, or aromatic hydrocarbon groups. Use of compounds in accordance with the invention have been found to provide surprisingly superior results relative to use of otherwise similar compounds when R represents a non-aromatic linking group but where the proviso is not satisfied (e.g., where each of $R^1$, $R^2$, $R^3$ and $R^4$ comprise n-alkyl non-branched groups).

Specific examples of compounds of Formula I include, but are not limited to, the following:

Formula I

Ia

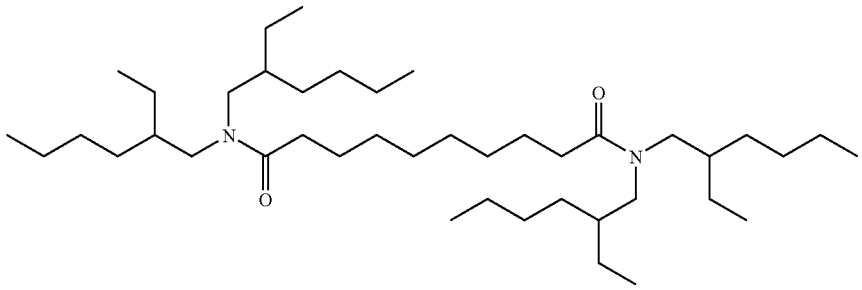

-continued
Ib
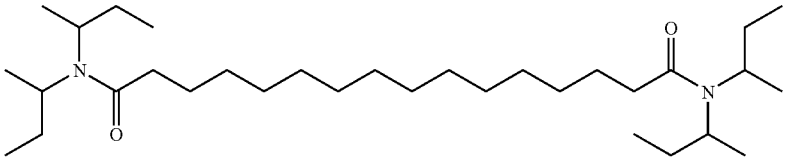
Ic
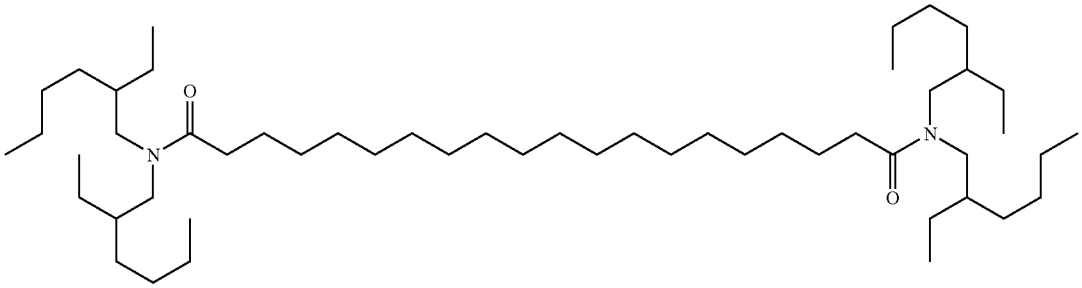
Id
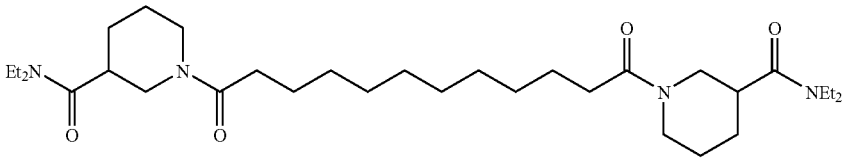
Ie
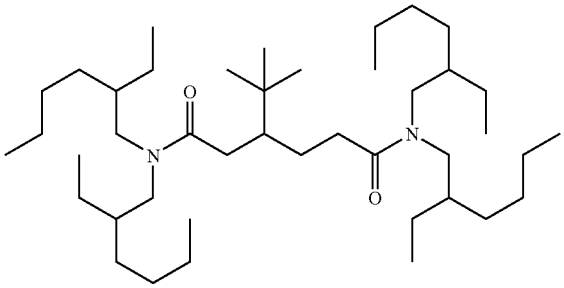
If
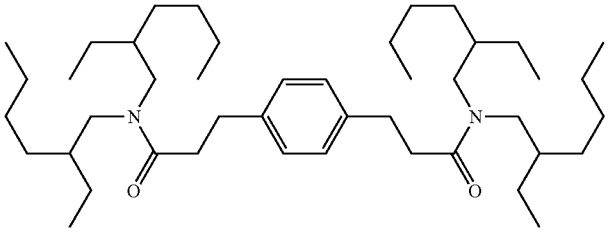
Ig
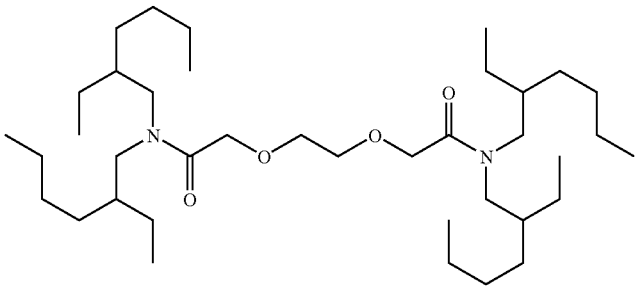

-continued
Ih
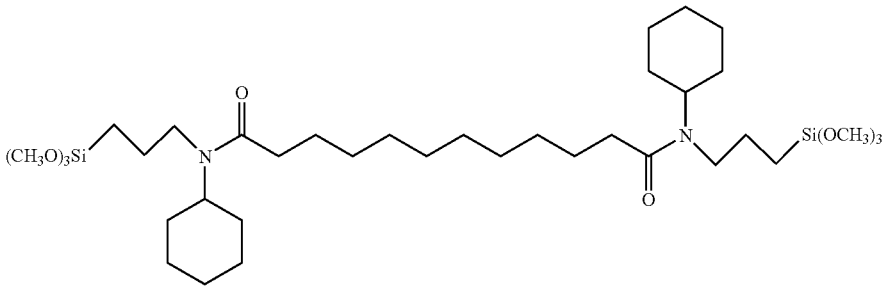
Ii
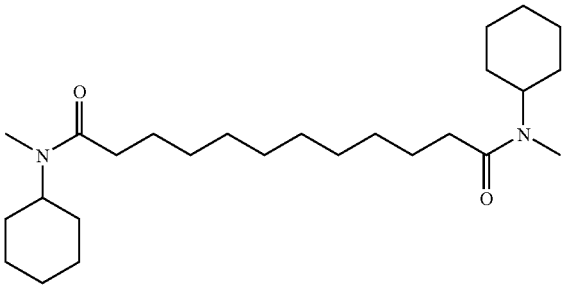
Ij
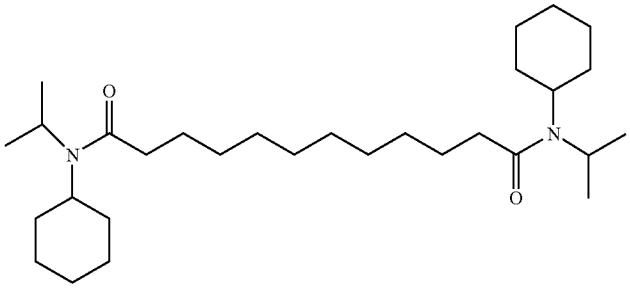
Ik
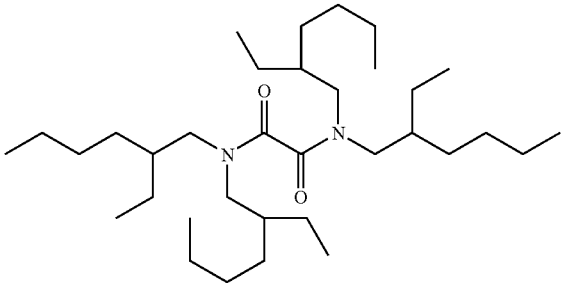
Il
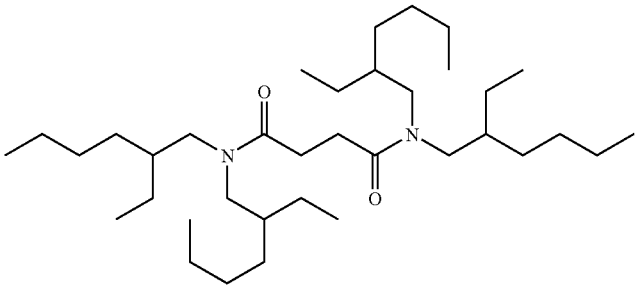

-continued
Im
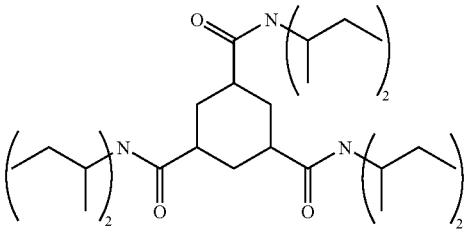
In
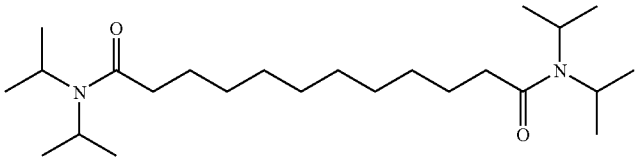
Io
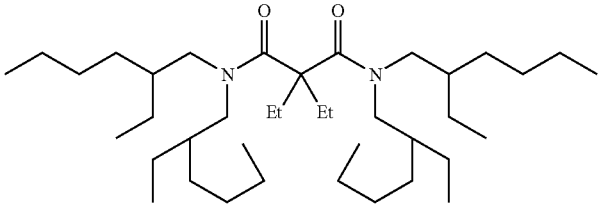
Ip
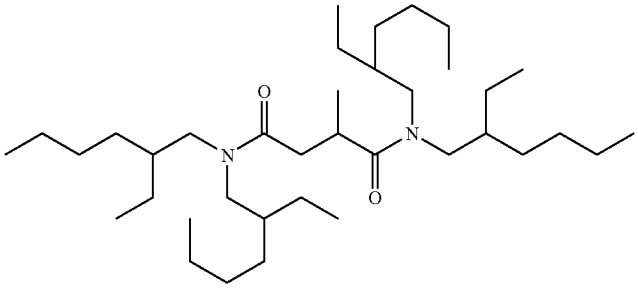
Iq
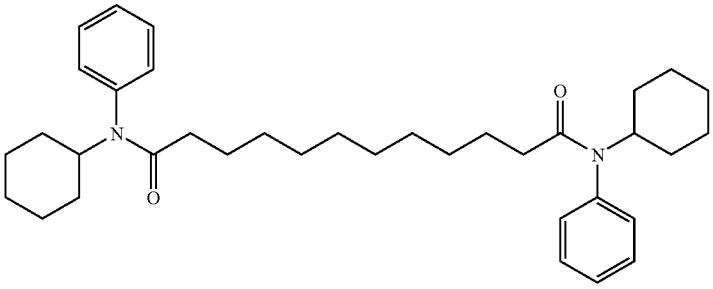
Ir
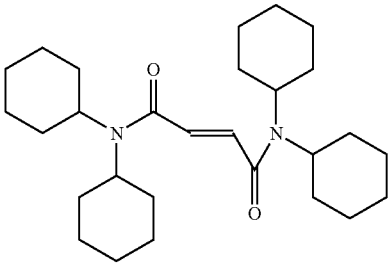

-continued
Is
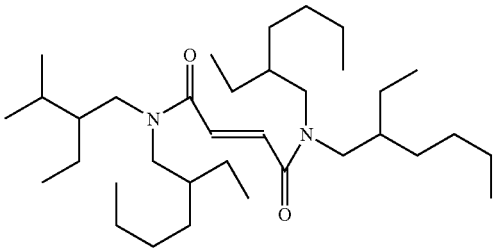
It
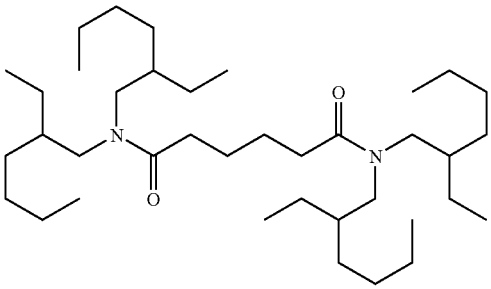
Iu
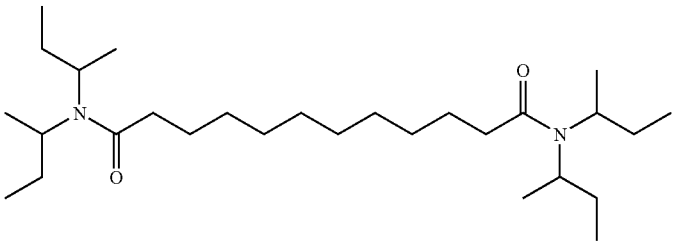
Iv
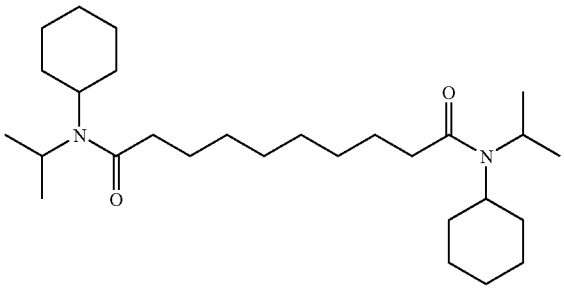
Iw
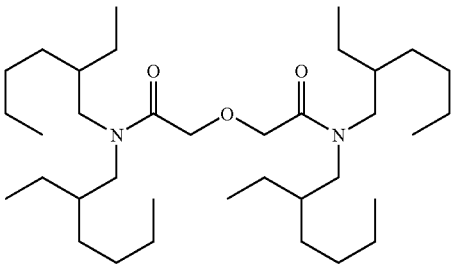

-continued
Ix
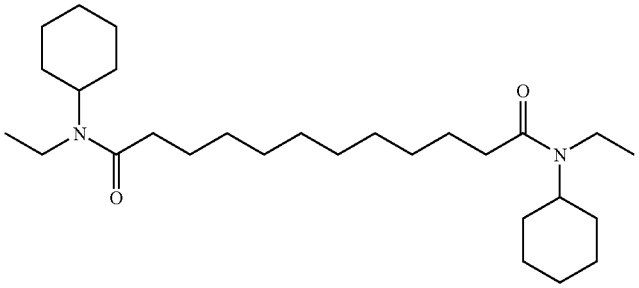
Iy
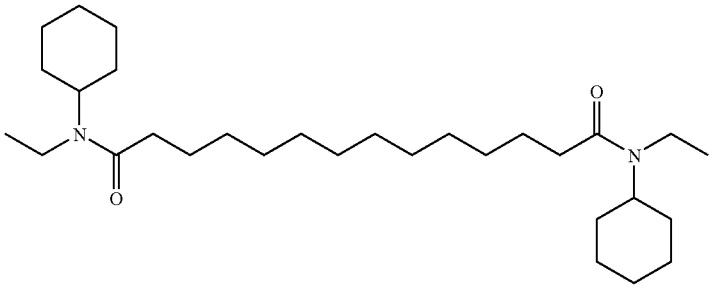
Iz
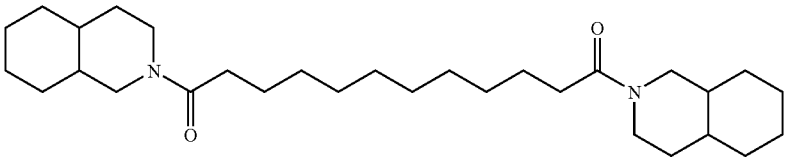
Iaa
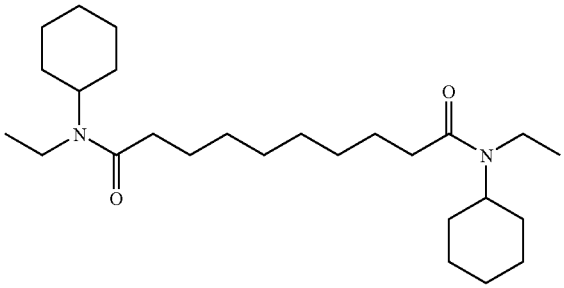
Ibb
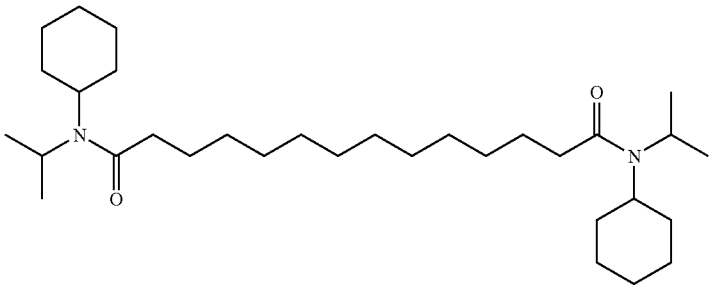
Icc
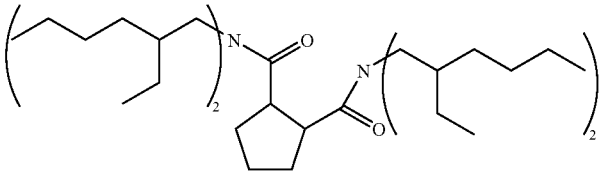

-continued
Idd
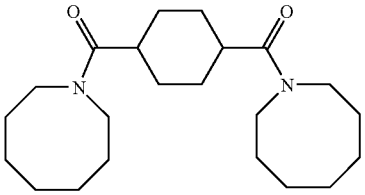
Iee
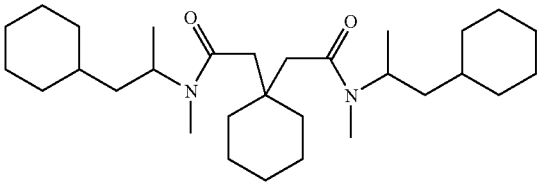
Iff
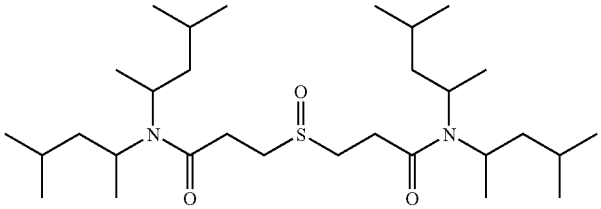
Igg
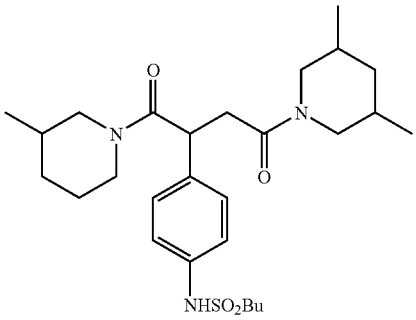
Ihh
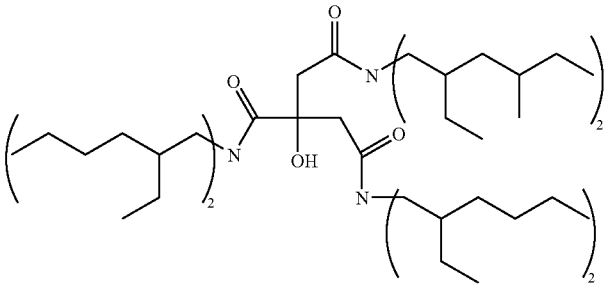
Iii
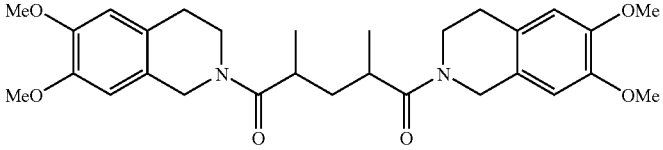

-continued
Ijj
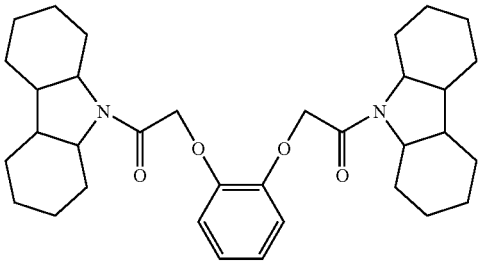
Ikk
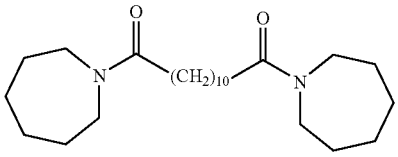
Ill
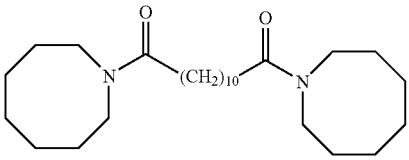
Imm
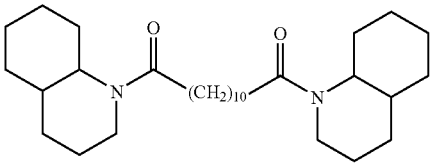
Inn
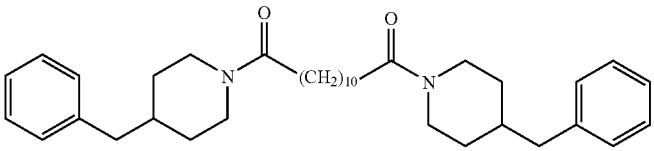
Ioo
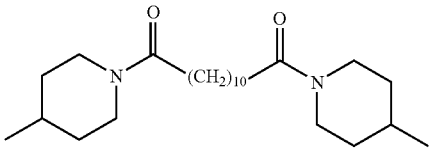
Ipp
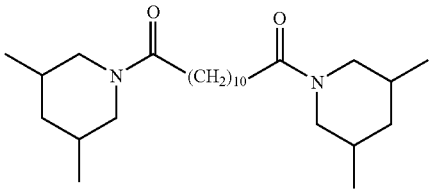
Iqq
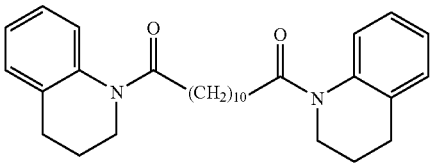
Irr
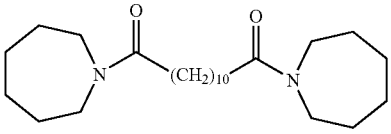

-continued
Iss
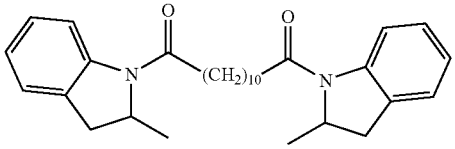
Itt
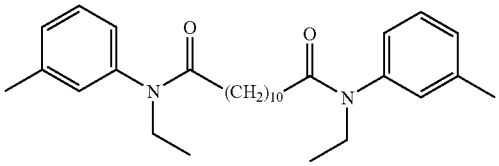
Iuu
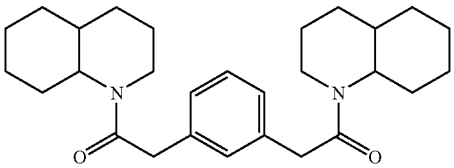
Ivv
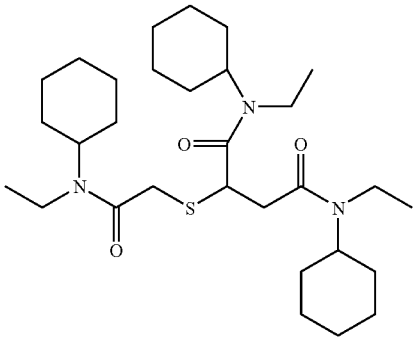
Iww
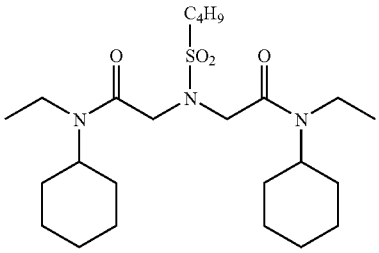
Ixx
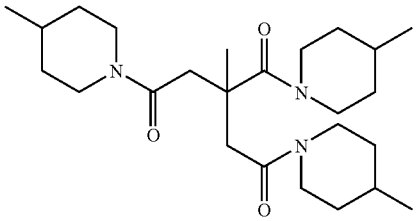
Iyy
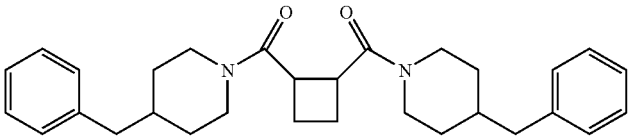

-continued

Izz

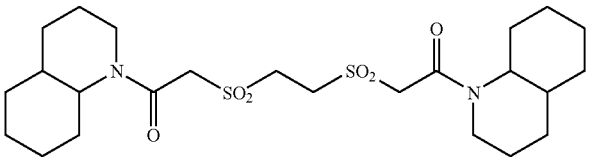

Iaaa

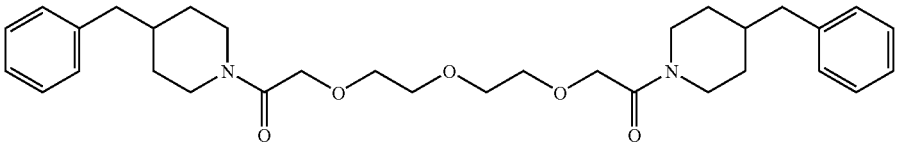

Ibbb

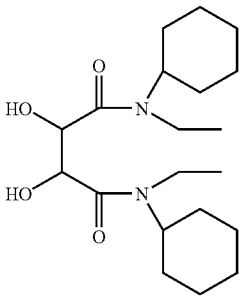

Iccc

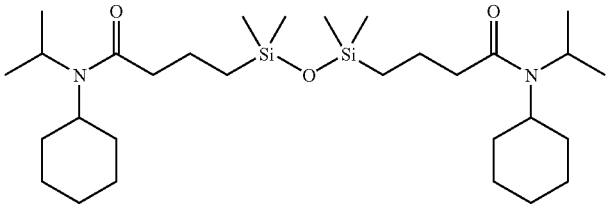

Iddd

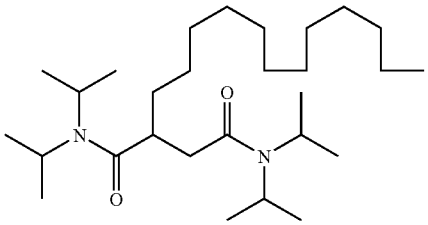

Syntheses of these compounds may use standard procedures. A convenient general reaction scheme which may be used comprises reaction of a diacid chloride of the formula ClC(O)—R—C(O)Cl with 2 equivalents of an amine of formula $HNR^1R^2$ in the presence of triethylamine and tetrahydrofuran (or other solvent).

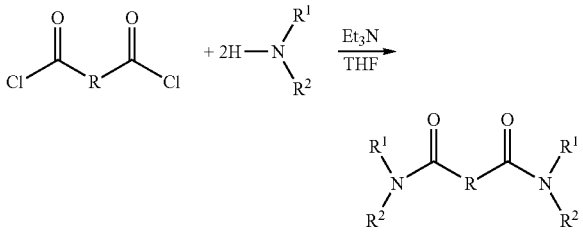

Representative syntheses for compounds, which may be used in accordance with the invention, are exemplified in U.S. Pat. No. 6,846,620 (B1).

In accordance with the embodiment of the present invention, the compounds of Formula I are used in combination with a phenolic compound of Formula P:

(P)

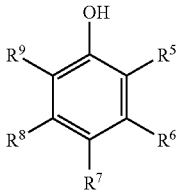

In formula P each of $R^5$, $R^6$, $R^7$, $R^8$ and $R^9$ independently represents a substituent as described above or hydrogen, or $R^5$ and $R^6$ or $R^6$ and $R^7$ or $R^7$ and $R^8$ or $R^8$ and $R^9$ may combine together to form a ring. Examples of the linear or branched chain alkyl group represented by $R^5$ to $R^9$ include a methyl group, an ethyl group, a propyl group, an isopropyl group, a butyl group, a sec-butyl group, a tert-butyl group, a pentyl group, a tert-pentyl group, a hexyl group, an octyl group, a tert-octyl group, a nonyl group, a decyl group, a dodecyl group, a tert-dodecyl group, a sec-tetradecyl group, an iso-palmityl group, a stearyl group, an iso-stearyl group, a 1-propenyl group, a 2-propenyl group, a cyclohexyl group, a cyclopentyl group, or a cyclooctyl group. Examples of rings formed between $R^5$ and $R^6$ or $R^6$ and $R^7$ or $R^7$ and $R^8$ or $R^8$ and $R^9$ are cyclohexyl, cyclopentyl, or cyclooctyl. The groups $R^5$ to $R^9$ may be substituted with a halogen atom: a fluorine atom, a chlorine atom, a bromine atom or an iodine atom. The groups $R^5$ through $R^9$ may also be substituted with one or more heteroatoms selected from oxygen, sulfur of various oxidation states, or nitrogen atoms. Groups $R^5$ through $R^9$ may also contain substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art.

Two or more P units or different P' units may be connected via a link L as shown below:

P—L—P' wherein P and P', as described above, may be equivalent or different; L is a cyclic, linear or branched chain hydrocarbon group or substituted hydrocarbon linking group, as defined above, or a sulfonyl, carboxy, or amido group. More specifically the structures of this type may be represented by the formula below:

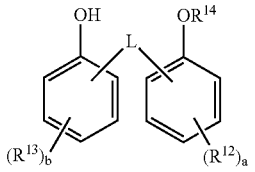

where $R^{12}$ and $R^{13}$ are defined the same as $R^5$ through $R^9$ above. $R^{14}$ may be hydrogen, linear, branched or cyclic substituted or unsubstituted hydrocarbon, aryl, substituted aryl, alkylsulfonyl, or arylsulfonyl; $R^{14}$ and $R^{12}$ may form a ring. The carbon of $R^{14}$ attached to oxygen can be any substituent as long as it is not a carbonyl, such as in an acetyl moiety. Particularly useful are compounds wherein $R^{14}$ is hydrogen. Both a and b are integers between 0 and 4. Preferably a and b are 2. L represents a single bond or a bivalent linking group, for example an alkyl or substituted alkyl as given above or a heteroatom taken from O, S, P or N. Particularly useful are compounds wherein L is methylene or substituted methylene group. Specific examples of such blocked bisphenolic compounds, along with synthesis techniques, are disclosed, e.g., in U.S. Pat. Nos. 4,782,011 and 5,426,021, the disclosures of which are incorporated herein by reference. Additional substituted phenolic stabilizers which may be advantageously used in combination with the invention include those described in U.S. Pat. Nos. 5,091,294, 5,284,742, 5,935,773 and EP 0 310 551 and EP 0 310 552.

Compound P1, the mono-acetyl blocked bisphenol, is included as a check compound from U.S. Pat. No. 6,555,306(B1). Specific examples of compounds of Formula P include, but are not limited to, the following:

Check Phenol

P1

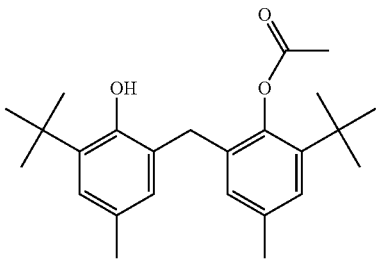

P2

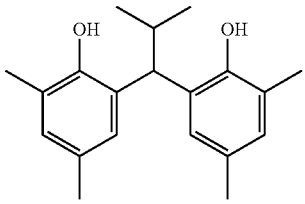

-continued
P3
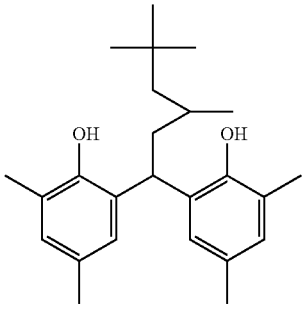
P4
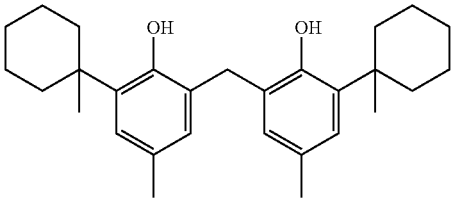
P5
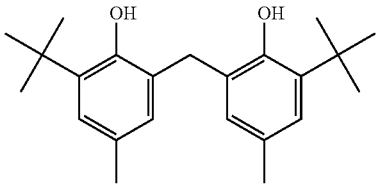
P6
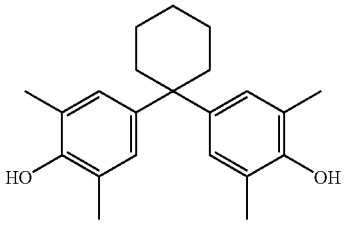
P7
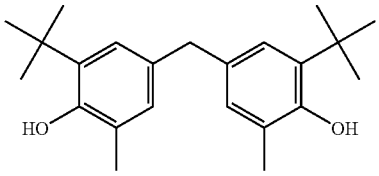
P8
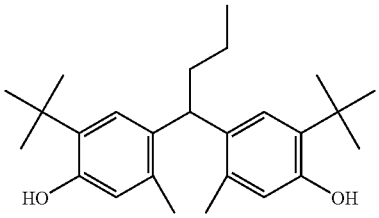
P9
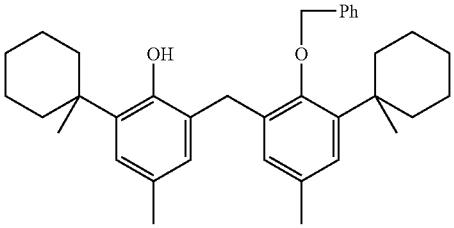

-continued
P10
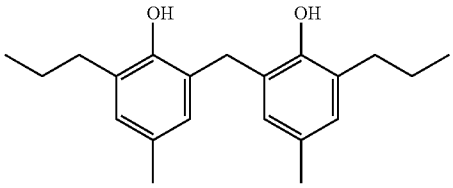
P11
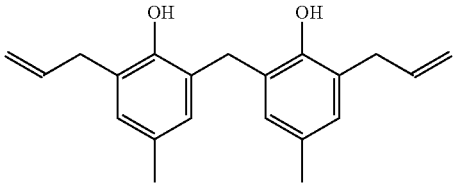
P12
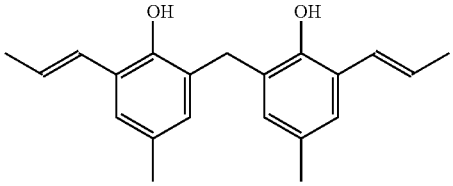
P13
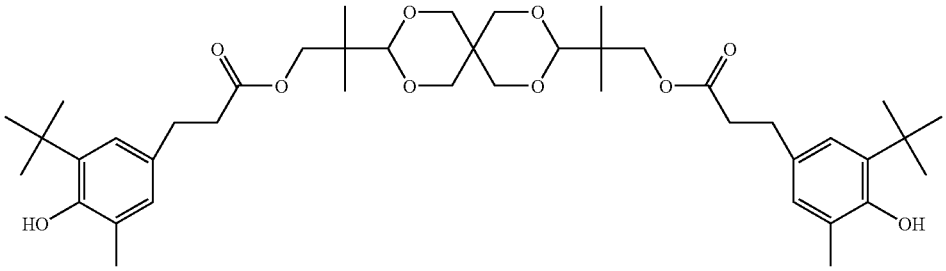
P14
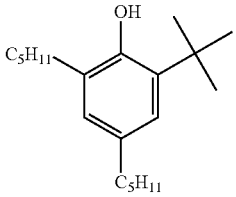
P15
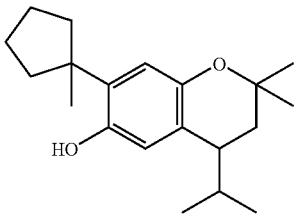
P16
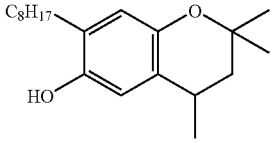
P17
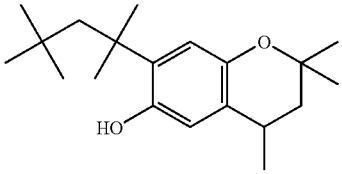

-continued
P18
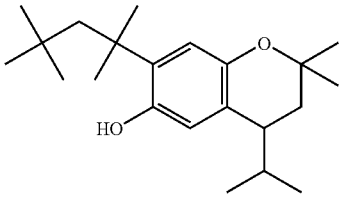
P19
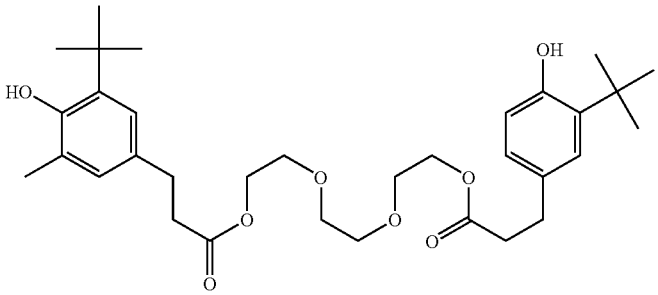
P20
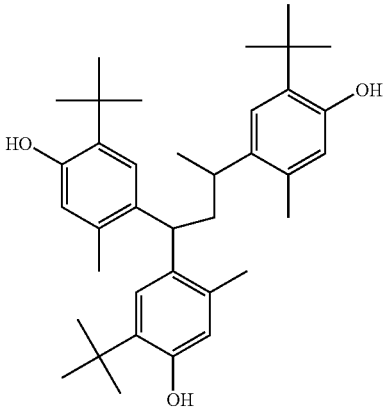
P21
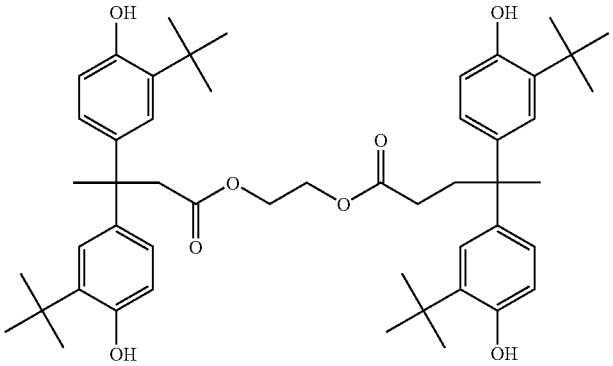
P22
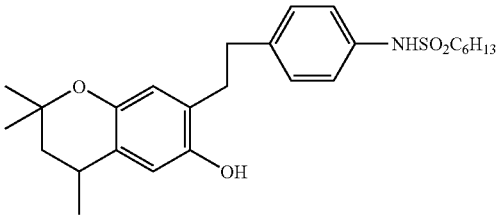

-continued
P23
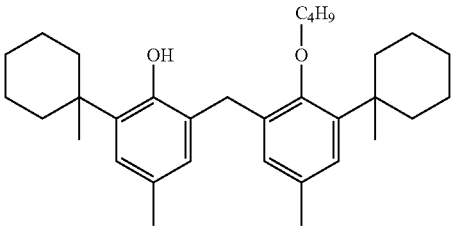
P24
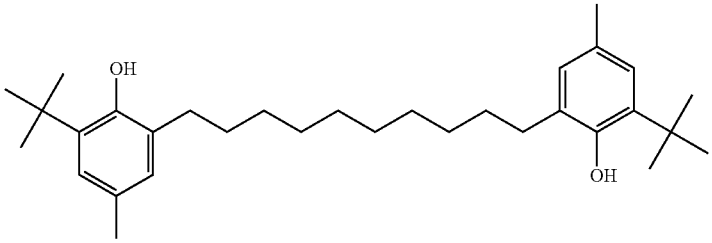
P25
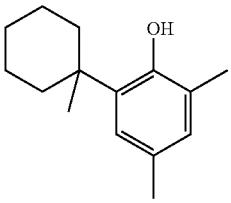
P26
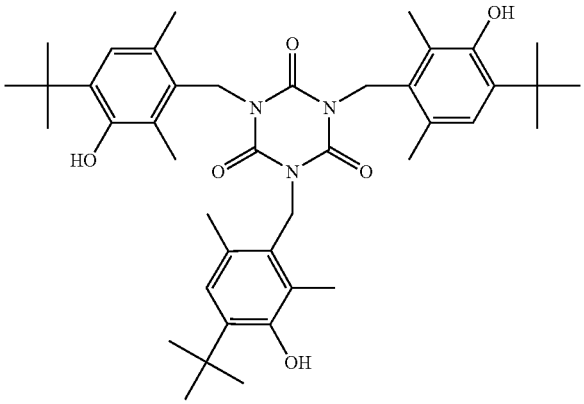
P27
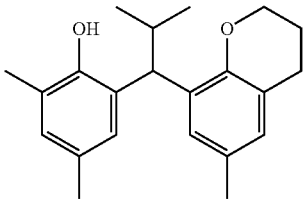
P28
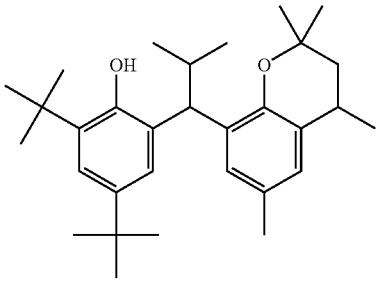

-continued
P29
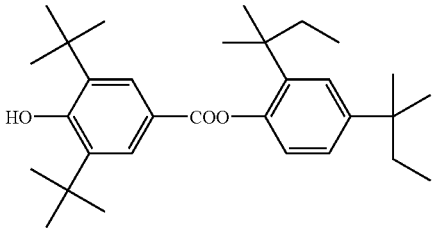
P30
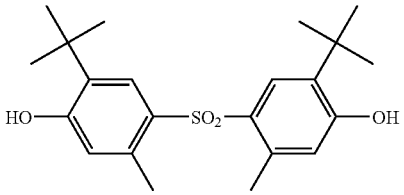
P31
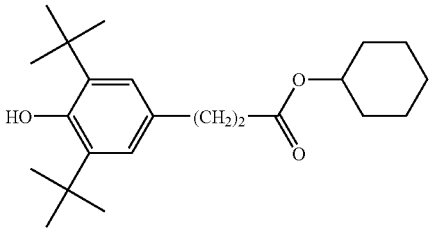
P32
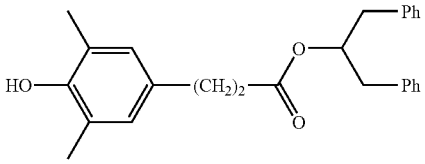
P33
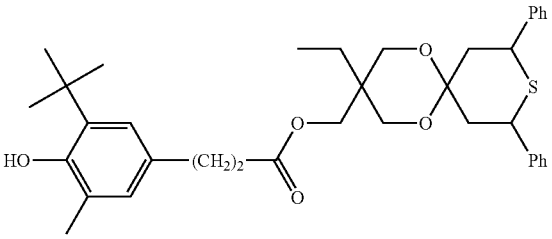
P34
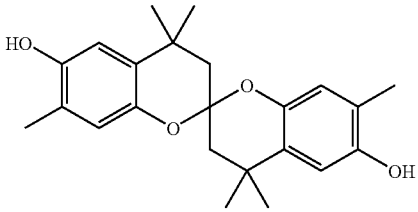
P35
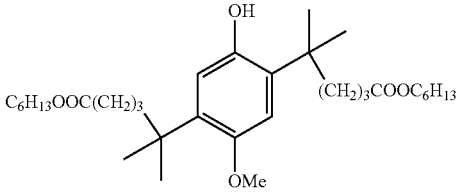

-continued

P36

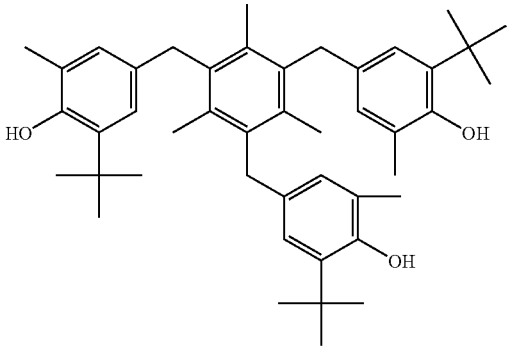

P37

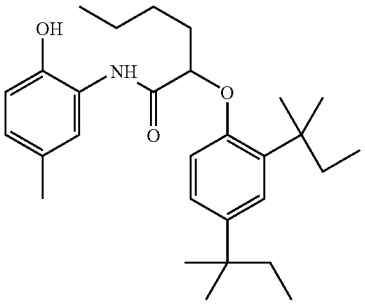

P38

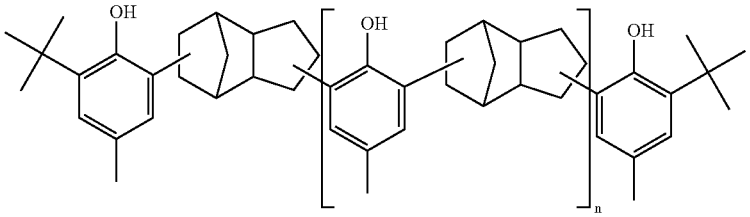

P39

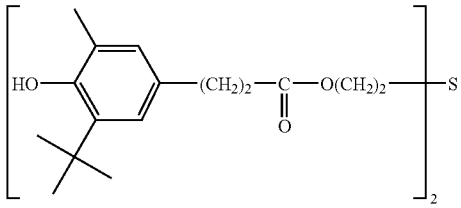

P40

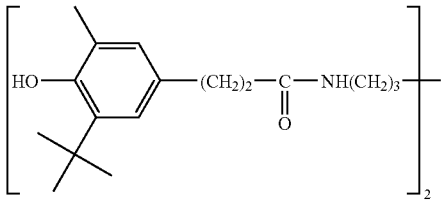

Compounds I and P above are required to be in combination with an electron rich aromatic compound of Formula EA:

(EA)

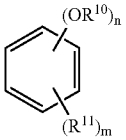

wherein $R^{10}$ represents a substituent, such as an aromatic, cyclic, linear or branched chain hydrocarbon group, or two $R^{10}$ groups or an $R^{10}$ and an $R^{11}$ may join to form a ring. These groups are defined the same as above. For example: methyl, ethyl, propyl, butyl, pentyl, hexyl, phenyl, para-methoxyphenyl, cyclohexyl, or cyclopentyl. As above the cyclic, linear, and branched hydrocarbon groups may be substituted with any substituents which do not negatively effect the desired properties of these compounds, in particular the coating ability and stabilization ability of these electron rich aromatics. In the Formula EA, n is an integer of 2 to 6 and m is an integer of 0 to 4. $R^{11}$ represents a hydrogen or a substituent as described above or two $R^{11}$ groups may join to form a carbocyclic ring. Two or more EA or different EA' units may connect together via a link X as shown below:

EA—X—EA' wherein X is the same as L defined above, for example, a cyclic, linear or branched chain hydrocarbon group or substituted hydrocarbon group or an oxo, thio, sulfonyl, carboxy, or amido group. $R^{10}$ and $R^{11}$ may form a ring that acts as X linking two EA units or two $R^{11}$ groups may form a ring that acts as an X linking two or more EA groups together.

Specific examples of compounds of Formula EA include, but are not limited to, the following:

EA1

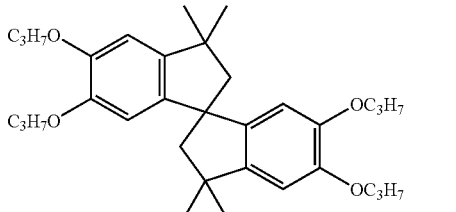

EA2

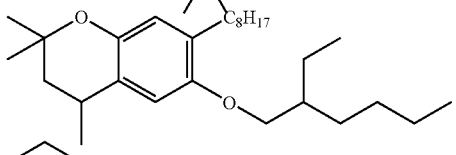

EA3

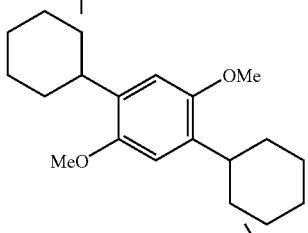

EA4

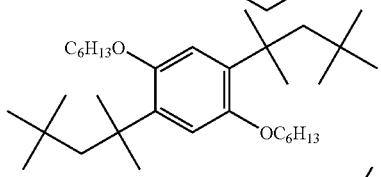

EA5

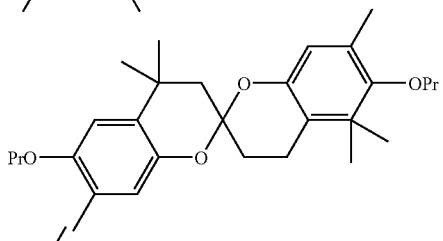

EA6

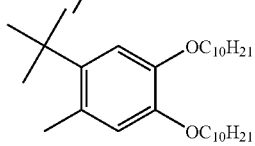

EA7

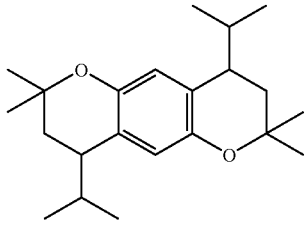

EA8

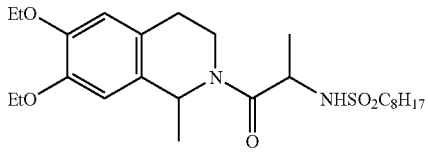

-continued
EA9
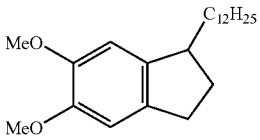
EA10
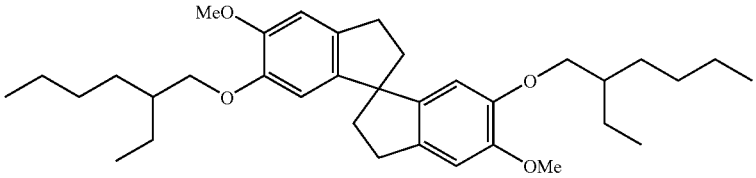
EA11
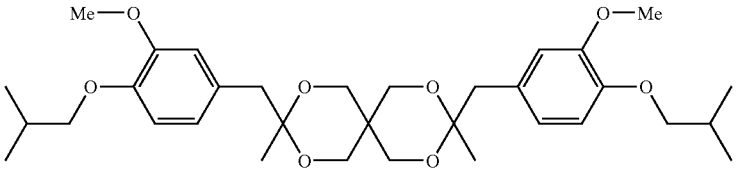
EA12
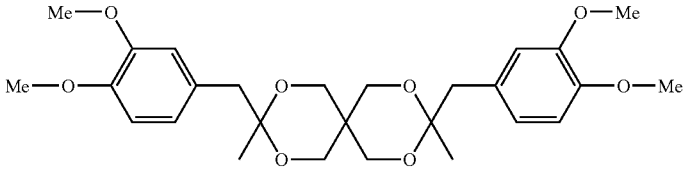
EA13
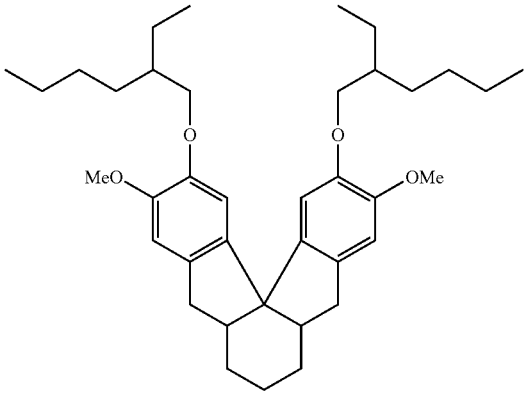
EA14
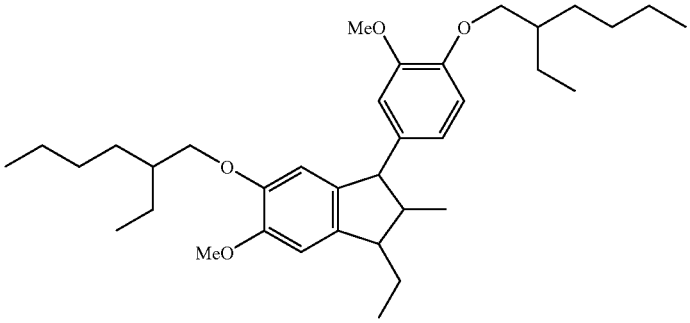
EA15
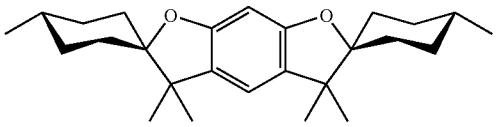

-continued
EA16
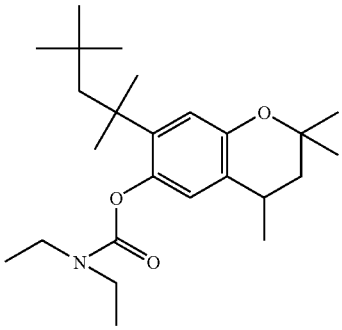
EA17
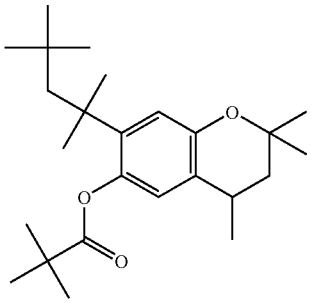
EA18
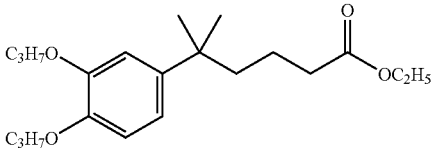
EA19
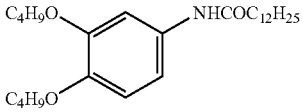
EA20
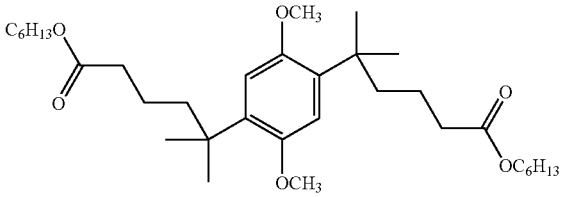
EA21
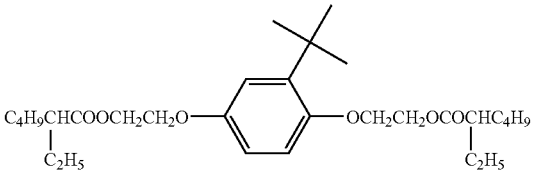
EA22
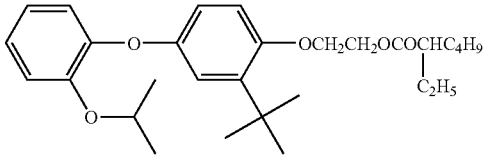

-continued
EA23
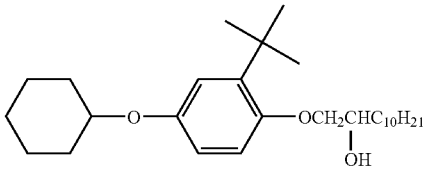
EA24
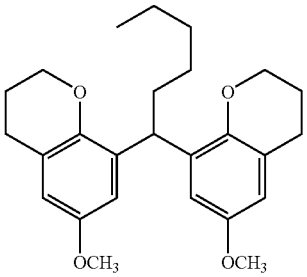
EA25
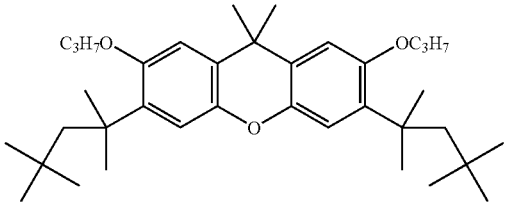
EA26
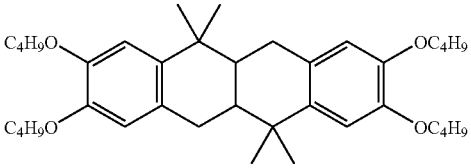
EA27
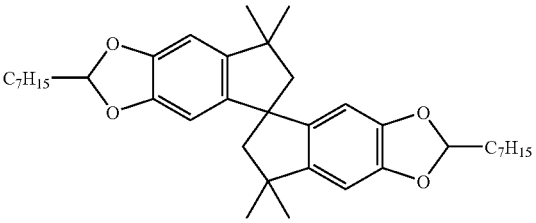
EA28
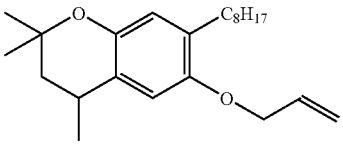
EA29
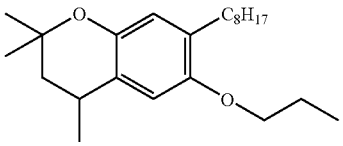

-continued
EA30
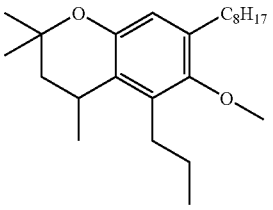
EA31
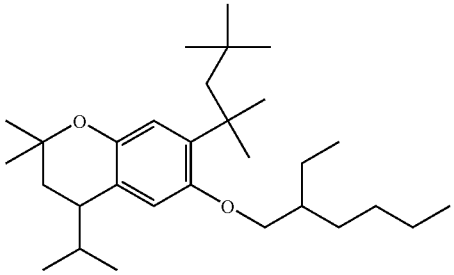
EA32
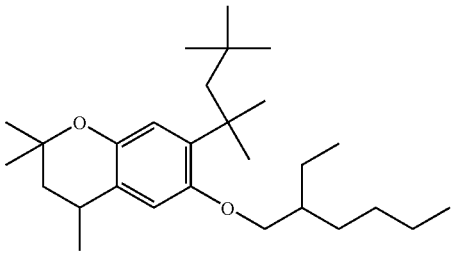
EA33
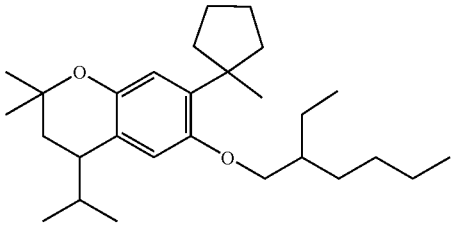
EA34
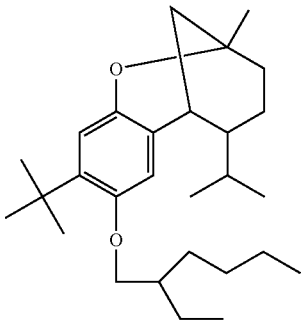
EA35
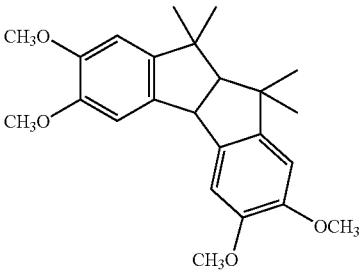

-continued

EA36

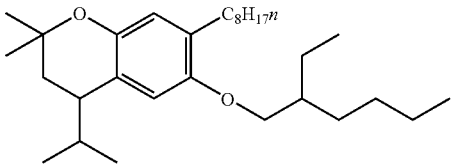

EA37

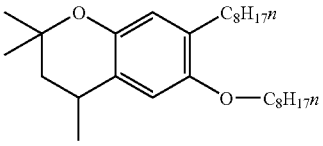

EA38

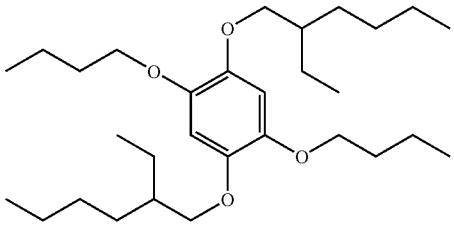

In accordance with a preferred embodiment of the present invention, the compounds of Formula I, P and EA are used in combination with yellow, magenta, or cyan dye-forming couplers, and in particular acetanilide-based yellow dye forming coupler compounds. Such couplers are known compounds and can be prepared by techniques known to those skilled in the art. Individual yellow couplers may be used singly or in combinations. Couplers that form yellow dyes upon reaction with oxidized color developing agent and which are useful in elements of the invention are described, e.g., in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred acetanilide-based yellow couplers are represented by the following formulas:

YELLOW-1

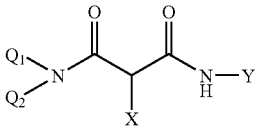

YELLOW-2

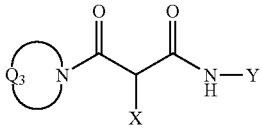

-continued

YELLOW-3

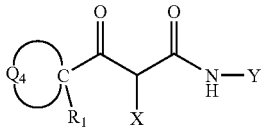

YELLOW-4

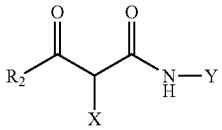

Also in the embodiment of the present invention are the azomethine dye forming couplers of Formula YELLOW-5, as described in EP 1,246,006 A2.

Yellow-5

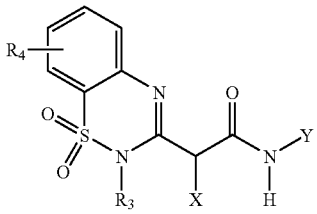

In the above yellow couplers, $R_1$, $R_2$, $R_3$, $R_4$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group. The elements of the invention are particularly useful in combination with yellow couplers of the above formulas wherein X represents a nitrogen-containing heterocyclic coupling-off group.

Representative couplers, which may be used in the elements of the invention, include but not limited by the following yellow couplers YC1–YC27:

YC1

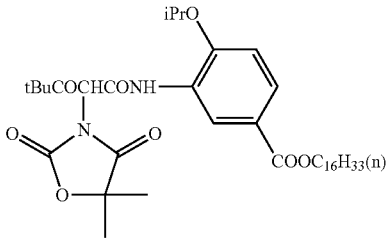

YC2

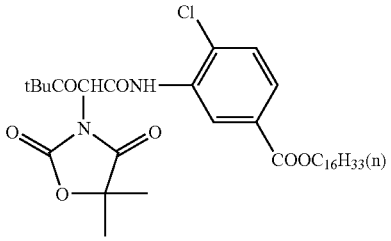

YC3

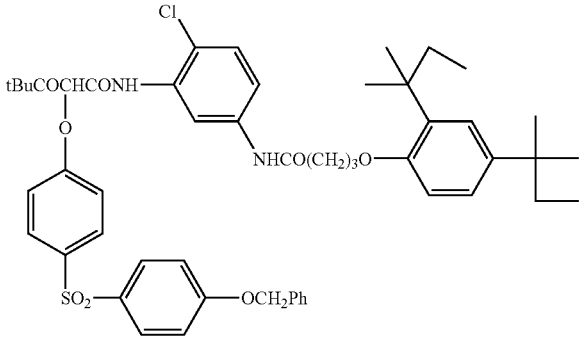

YC4

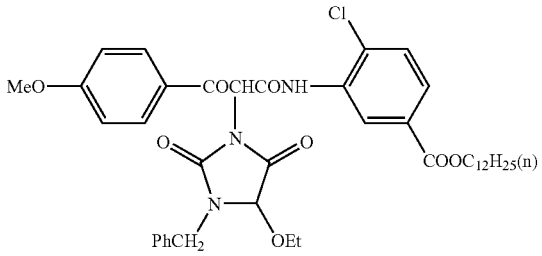

-continued

YC5

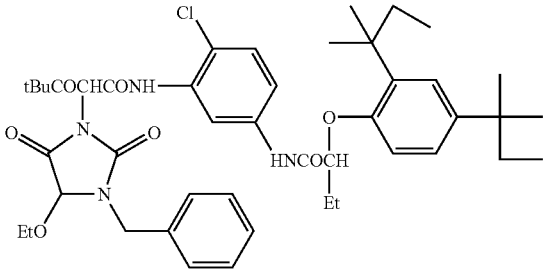

YC6

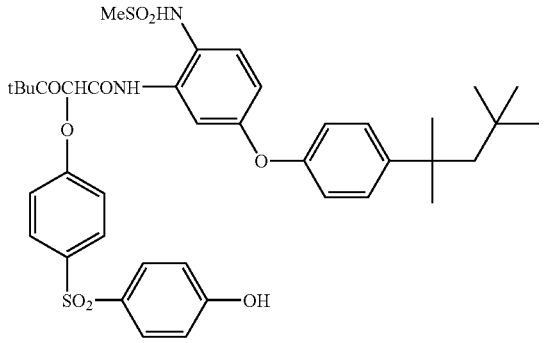

YC7

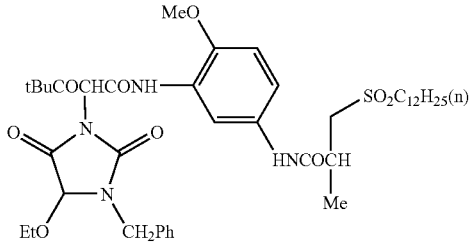

YC8

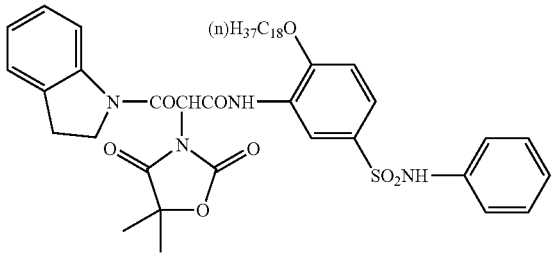

YC9

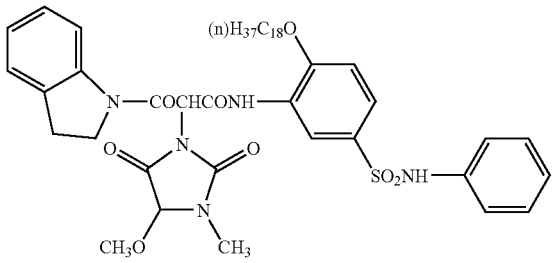

-continued
YC10
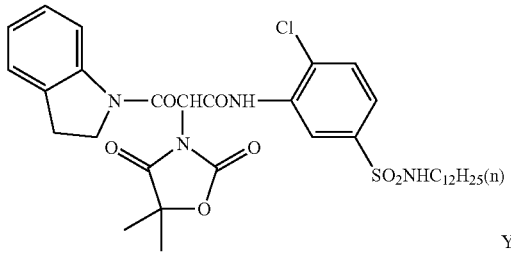
YC11
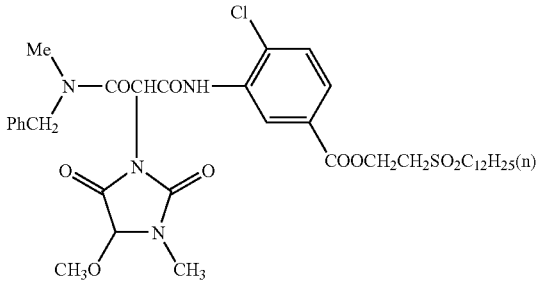
YC12
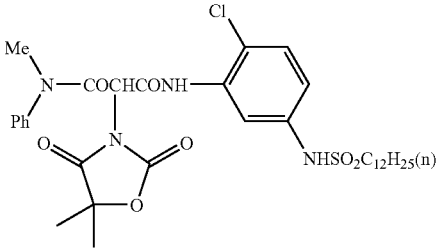
YC13
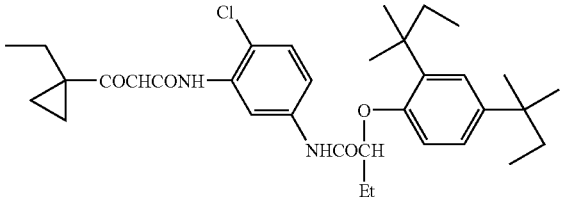
YC14
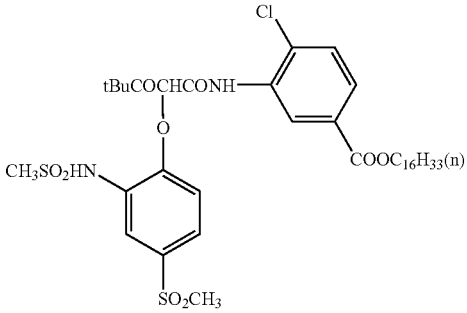
YC15
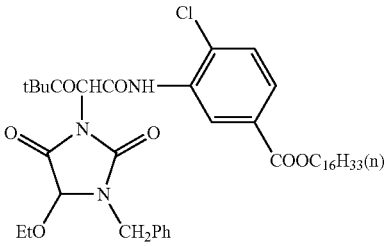
-continued
YC16
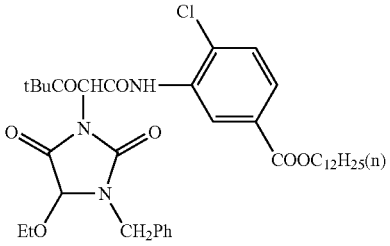
YC17
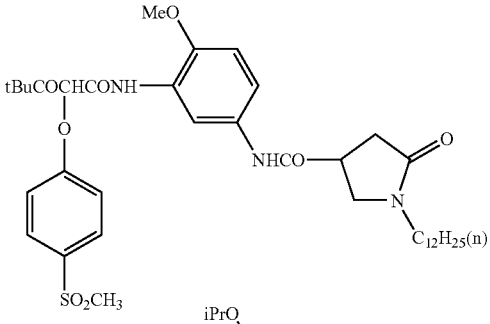
YC18
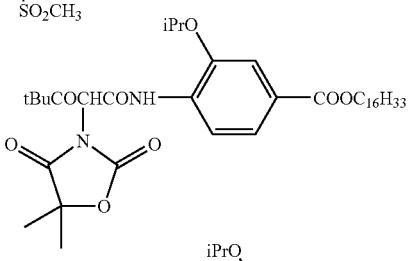
YC19
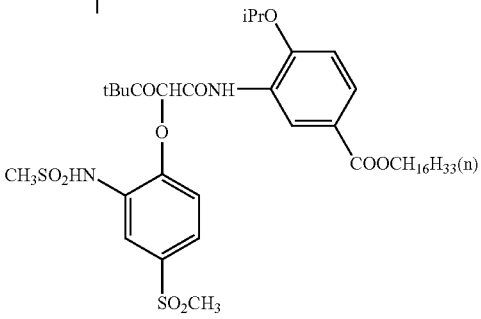
YC20
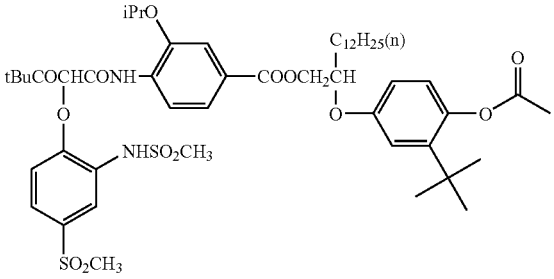
YC21
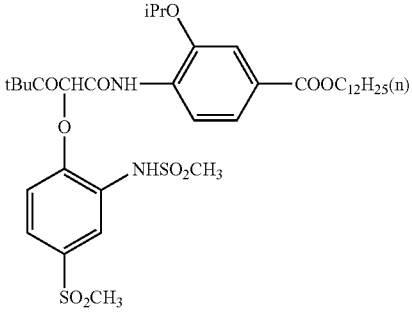

-continued

YC22

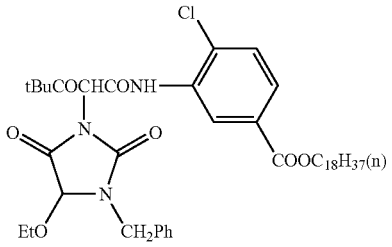

YC23

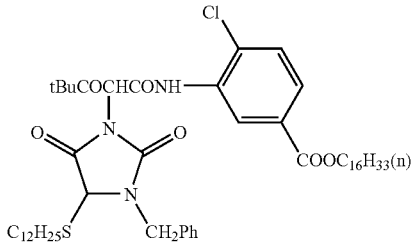

YC24

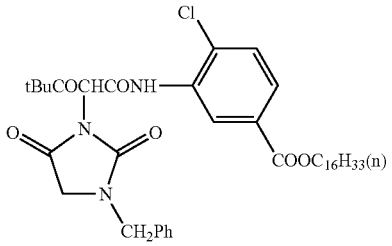

YC25

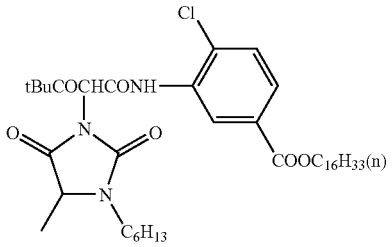

YC26

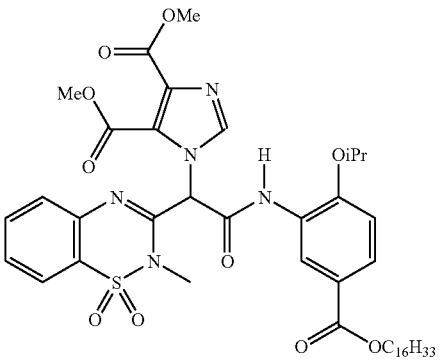

-continued

YC27

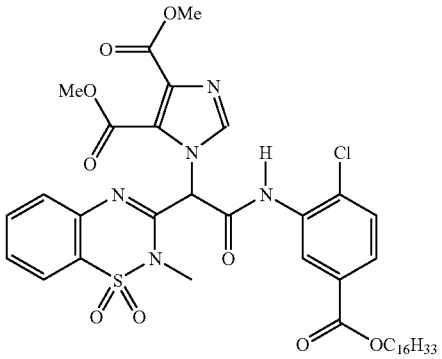

Typically, couplers and the stabilizers with which they are associated are dispersed in the same layer of the photographic element in a permanent high boiling organic compound known in the art as a coupler solvent, either alone or with auxiliary low boiling or water miscible solvents which are removed after dispersion formation. Permanent high boiling solvents have a boiling point sufficiently high, generally above 150° C. at atmospheric pressure, such that they are not evaporated under normal dispersion making and photographic layer coating procedures. Alternatively, the couplers and stabilizers may be dispersed without permanent high boiling solvents using only auxiliary solvent or precipitation techniques as is known in the art. The compounds may be co-dispersed, or may be dispersed separately and then combined. Representative conventional coupler solvents include phthalic acid alkyl esters such as diundecyl phthalate, dibutyl phthalate, bis-2-ethylhexyl phthalate, and dioctyl phthalate, phosphoric acid esters such as tricresyl phosphate, diphenyl phosphate, tris-2-ethylhexyl phosphate, and tris-3,5,5-trimethylhexyl phosphate, citric acid esters such as tributyl acetylcitrate, tributylcitrate and trihexylcitrate, 2-(2-Butoxyethoxy)ethyl acetate, and 1,4-cyclohexyldimethylene bis(2-ethylhexanoate), benzoic acid esters such as octyl benzoate, aliphatic amides such as N,N-diethyl lauramide, N,N-diethyldodecanamide, N,N-dibutyldodecanamide, mono and polyvalent alcohols such as oleyl alcohol and glycerin monooleate, and alkyl phenols such as p-dodecyl phenol and 2,4-di-t-butyl or 2,4-di-t-pentyl phenol. Commonly used coupler solvents are the phthalate esters, which can be used alone or in combination with one another or with other coupler solvents. Selection of the particular coupler solvent has been found to have an influence on the activity of the coupler as well as the hue and stability of the dye formed on coupling. In accordance with certain embodiments, the compounds of Formula I may be advantageously used to partly or totally replace conventional high boiling solvents in dispersing the dye-forming couplers in the photographic elements of the invention.

Typically the amount of compound I (or total solvent in the case of a mixture of solvents) used will range from about 0.05 to about 4.0 moles per mole of coupler, preferably from about 0.1 to 2.5 moles per mole of coupler. The coupler is typically coated in the element at a coverage of from 0.25 $mmol/m^2$ to 2.0 $mmol/m^2$, and preferably at a coverage of from 0.40 to 1.2 $mmol/m^2$. When used as a permanent coupler solvent, compounds of formula I will typically be employed in an amount of 0.1 to 5.0 mg/mg coupler, and preferably in an amount of 0.25 to 2.0 mg/mg coupler.

To further enhance the stability of the dyes formed in photographic elements in accordance with the invention, additional conventional stabilizing compounds may also be included. In accordance with a particularly preferred embodiment, the use of compounds of Formula I in combination with conventional phenolic and electron rich aromatic dye stabilizers have been found to unexpectedly provide beneficial yellow-formed dye light stability.

Substituted bisphenol light stabilizer compounds, which may be used in accordance with preferred embodiments of the invention generally, may be used at similar concentrations to those of I. Preferably, the molar ratio of compound of Formula I to substituted phenolic light stabilizer compound is from 1:12 to 25:1. While it is an advantage of the invention that improved light stability may obviate the need for polymeric latex materials as light stabilizers, they may also be incorporated if desired. Specifically, the polymer latex materials as described in U.S. Pat. No. 5,981,159 may be employed. To obtain a satisfactory color and tonal balance as photographic images fade on exposure to light, it is important to achieve a balanced rate of density loss from yellow, magenta and cyan dyes. It is particularly desirable to produce a balanced rate of yellow and magenta dye loss in order to maintain a pleasing reproduction of skin tones. In accordance with preferred embodiments of the invention, a balanced rate of fade can be achieved using a yellow dye-forming layer comprising a stabilizer combination in accordance with preferred embodiments of this invention in combination with a magenta dye-forming coupler layer comprising highly-stable pyrazolotriazole coupler.

Image dye forming couplers that form magenta dyes upon reaction with oxidized color developing agents may be included in elements of the invention, such as are described in representative patents and publications such as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Typical pyrazoloazole and pyrazolone couplers are represented by the following formulas:

MAGENTA-1

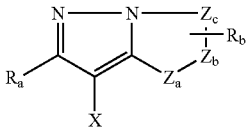

-continued

MAGENTA-2

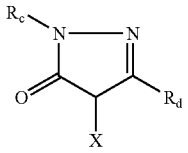

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$.

Image dye forming couplers that form cyan dyes upon reaction with oxidized color developing agents may be included in elements of the invention, such as are described in representative patents and publications such as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

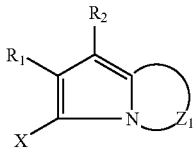

CYAN-2

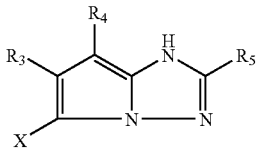

CYAN-3

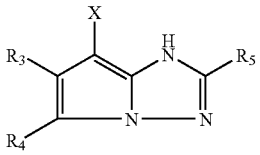

CYAN-4

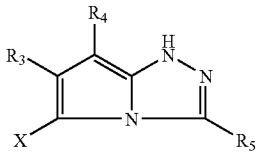

-continued

CYAN-5

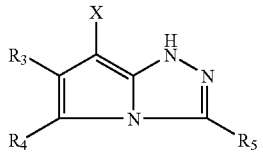

CYAN-6

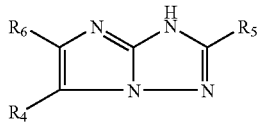

wherein $R_1$ and $R_5$ each represent a hydrogen or a substituent; $R_2$ represents a substituent; $R_3$ and $R_4$ each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g.—N—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill).

More preferable are cyan couplers of the following formulas:

CYAN-7

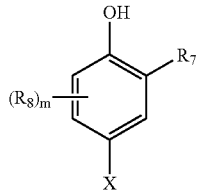

CYAN-8

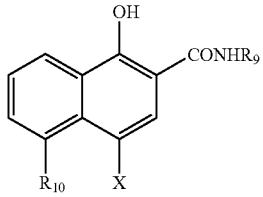

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Photographic elements of this invention can have the structures and components described in an article titled "Typical and Preferred Color Paper, Color Negative, and Color Reversal Photographic Elements and Processing," published in Research Disclosure, February 1995, Item 37038, pages 79–114. Research Disclosure is published by Kenneth Mason Publications, Ltd., Dudley Annex, 12a North Street, Emsworth, Hampshire P010 7DQ, ENGLAND. A typical multicolor photographic element of this invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support, which can be transparent or reflective. In a preferred embodiment, the invention is directed towards a photographic element that may be displayed for extended periods under illuminated conditions, such as a color paper photographic element, which comprises photographic layers coated on a reflective support. Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523.

While the order of the color sensitive layers in a photographic element in accordance with various embodiments of the invention can be varied, they will normally be red-sensitive, green-sensitive and blue-sensitive, in that order on a transparent support, (that is, blue sensitive furthest from the support) and the reverse order on a reflective support being typical. The element typically will have a total thickness (excluding the support) of from 5 to 30 microns.

This invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as developer inhibitor releasing compounds (DIR's).

The elements of the present invention may be employed to obtain reflection color prints as described in *Research Disclosure*, November 1979, Item 18716, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Patent Applications 83/09,959; 83/62,586; 90/072,629, 90/072,630; 90/072,632; 90/072,633; 90/072,634; 90/077,822; 90/078,229; 90/078,230; 90/079,336; 90/079,338; 90/079,690; 90/079,691; 90/080,487; 90/080,489; 90/080,490; 90/080,491; 90/080,492; 90/080,494; 90/085,928; 90/086,669; 90/086,670; 90/087,361; 90/087,362; 90/087,363; 90/087,364; 90/088,096; 90/088,097; 90/093,662; 90/093,663; 90/093,664; 90/093,665; 90/093,666; 90/093,668; 90/094,055; 90/094,056; 90/101,937; 90/103,409; 90/151,577.

The silver halide emulsion grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with an oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are: 4-amino-N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water-soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The photographic elements comprising stabilizers in accordance with this invention may be processed in amplification processes that use developer/amplifier solutions described in U.S. Pat. No. 5,324,624, for example. When processed in this way, the low volume, thin tank processing system and apparatus described in U.S. Pat. No. 5,436,118 preferably is employed.

EXAMPLES

Synthesis Examples

Iu: Triethylamine (7.95 g; 78.5 mmol) and di-sec-butylamine (9.9 g; 76.7 mmol) were dissolved in THF (300 mL) and cooled in an ice bath. Dodecanedioyl dichloride (10 g; 37.4 mmol) dissolved in THF (100 mL) was added drop wise and the heterogeneous mixture was allowed to warm to room temperature and stir over night. The white salts were removed by filtration and the salts washed with THF. Most of the THF was removed from the filtrate under vacuum and the resulting solution was poured into 1.8 L of dilute HCl/ice water. The solution was extracted with dichloromethane (2x's) and the combined organic layers were dried ($Na_2SO_4$). Solvent removal under vacuum afforded 16.9 g of a pale yellow oil. Chromatography on silica gel with 96:4; dichloromethane:acetone afforded 10.5 g (62%) of the desired material (Iu) as a very pale yellow oil. MS, m/e=453 (P+1) in $ES^+$ mode.

Inn: Triethylamine (39.8 g; 393 mmol) and 4-benzylpiperidine (67.24 g; 384 mmol) were dissolved in THF (1 L) and stirred at room temperature. Dodecanedioyl dichloride (50 g; 187 mmol) dissolved in THF (250 mL) was added drop wise (slightly exothermic) and the heterogeneous white mixture was stirred at room temperature over night. The salts were removed by filtration and washed with THF (2x's). Most of the THF was removed from the filtrate under vacuum. The remaining liquid was poured into 2 L of dilute HCl/ice water and stirred over night. Filtration afforded a while solid that was washed with water and air dried to give 100.5 g. This material was passed through a slug of silica gel with 1:1; ethylacetate:heptane. The resultant solid was stirred in hexane and filtered to afford 80 g (78.5%) of the desired product (Inn) as a white solid. MS, m/e=545 (P+1) in $ES^+$ mode. Mp. 51–52° C.

The following photographic examples further illustrate this invention.

Example 1

Comparison

In this example (check), coupler of structure YC2 is employed. Also, in addition to coupler solvent tributyl citrate (TBC), stabilizers P1, P13 and S1 are employed:

P1

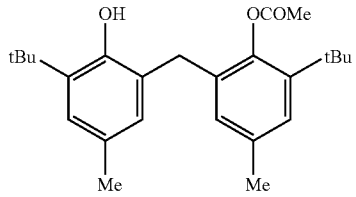

P13

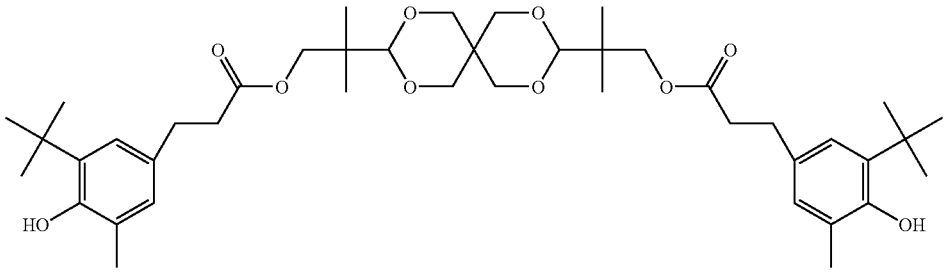

S1

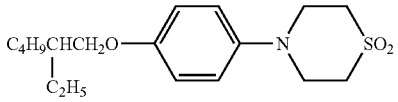

TBC

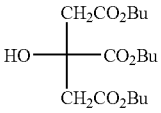

Coupler dispersions were prepared in accordance with conventional techniques by dissolving coupler YC2 in an equal weight of TBC with heating. Stabilizers P1, P13, and S1 were added to the yellow coupler oil phase (to provide indicated coated coverage), and the oil phase was dispersed in an aqueous phase containing gelatin and surfactant Alkanol-XC by homogenizing the mixture in a colloid mill. Each of the coupler dispersions was mixed with a blue-sensitive cubic silver chloride photographic emulsion for coating on a resin-coated paper support, pre-coated with an unhardened gel pad. The coating structure is shown below.

Coating Structure

| | |
|---|---|
| GEL SUPERCOAT | |
| Gelatin | 1.4 $g.m^{-2}$ |
| Hardener* | 0.15 $g.m^{-2}$ |
| Coating Surfactants | |
| PHOTOSENSITIVE LAYER | |
| Gelatin, | 2.15 $g.m^{-2}$ |
| Coupler | $5.93 \times 10^{-4}$ $mol/m^2$ |
| Coupler solvent | equal to weight of coupler |
| P1 | 0.0785 $g.m^{-2}$ |
| P13 | 0.0785 $g.m^{-2}$ |
| S1 | 0.0785 $g.m^{-2}$ |
| Ag Halide emulsion | 0.210 $g.m^{-2}$ (as Ag) |
| GEL PAD | |
| Gelatin | 3.230 $g.m^{-2}$ |
| Resin Coated Paper | |

*Hardener = bis(vinylsulphonylmethane)

Sample strips of the coatings were exposed to blue light through a step tablet (density range 0–3, 0.15 increments) and developed in standard Kodak RA4 processing solutions before washing and drying. Sensitometric curves were generated for each processed strip. The image dye light stability was assessed using simulated daylight fading equipment incorporating a rotating Xenon arc light source surrounded by window glass, delivering an exposure intensity of 50 Klux at the sample plane. Prior to fade testing, the samples were covered with a clear acetate film with UV-absorbing dye coating. At the end of these tests, the densities of the sample strips were re-measured and compared with the initial curves. Status "A" blue density changes from an initial density value of 1.0 after 3 weeks treatment (3wk HID) are recorded in the Tables below. In certain cases, longer periods of fade were followed (example 3).

Example 2

The following coating structure denotes an example of the coating structures for many of the experiments with the new compounds of this patent. In this coating, coupler of structure YC-2 is also employed. In addition to compound of Formula Ii, stabilizers P2 and EA1 are employed. Coupler dispersions were prepared in accordance with conventional techniques by dissolving coupler YC2 in an equal weight of solvent Ii in accordance with the invention with heating. Stabilizers P2 and EA1 were added to the yellow coupler oil phase (to provide indicated coated coverages), and the oil phase was dispersed in an aqueous phase containing gelatin and surfactant Alkanol-XC by homogenizing the mixture in a colloid mill. Each of the coupler dispersions was mixed with a blue-sensitive cubic silver chloride photographic emulsion for coating on a resin-coated paper support, pre-coated with an unhardened gel pad. The coating structure is shown below.

Coating Structure

| | |
|---|---|
| GEL SUPERCOAT | |
| Gelatin | 1.4 $g.m^{-2}$ |
| Hardener* | 0.15 $g.m^{-2}$ |
| Coating Surfactants | |
| PHOTOSENSITIVE LAYER | |
| Gelatin | 2.15 $g.m^{-2}$ |
| Coupler | $5.93 \times 10^{-4}$ $mol/m^2$ |
| Coupler solvent | equal to weight of coupler |
| P2 | 0.1577 $g.m^{-2}$ |
| EA2 | 0.07879 $g.m^{-2}$ |
| Ag Halide emulsion | 0.210 $g.m^{-2}$ (as Ag) |
| GEL PAD | |
| Gelatin | 3.230 $g.m^{-2}$ |
| Resin Coated Paper | |

*Hardener = bis(vinylsulphonylmethane)

Sample strips from these coatings were exposed, developed, and tested as in example 1 above. The following photographic examples illustrate this invention with supportive data.

Example 3

To demonstrate the effect of the claimed coupler solvent, combinations of P and EA were coated as stated above in both Tributyl Citrate (TBC) and Ix. In this experiment the coupler solvent level was 0.53X vs. the coupler. Table 1 reports the data for the various stabilizers coated in a coupler solvent of Formula I compared to the check solvent, TBC. As can be seen, it makes little to no difference as to dye loss which stabilizer or combination of stabilizers are coated in TBC (part A in table). However, in the claimed coupler solvent Ix the light stability can be increased almost 2 times depending on the stabilizers utilized (part B). The maximum stability is reached when coupler solvent I is combined with a phenol (P), which does not contain an acetyl blocked phenolic unit, such as check P1, and an electron rich aromatic compound (EA). As will be seen in the reported examples, the acetyl blocked bis-phenol P1 is an inferior light stabilizer under the conditions of this invention.

TABLE 1

Comparison of Stabilizers in TBC and Ix.

| Stabilizers | Stabilizer Ratio by Weight (Total Weight Constant @ 0.242 $g/m^2$) | T 0.3; Time to Fade to 0.3 loss from 1.0 (Ratio vs. Check) |
|---|---|---|
| A: Yellow coupler used throughout this experiments was YC2 and coupler solvent was TBC. Check is run using the stabilizer package from U.S. Pat. No. 6,555,306 (B1). | | |
| P1:P13:S1 | 1:1:1 | 1.00 Check |
| P1:P13:EA1 | 1:1:1 | 1.05 |
| P1:P2:EA1 | 1:1:1 | 1.13 |
| P2:P13:EA1 | 1:1:1 | 1.05 |
| P2:S1 | 2:1 | 1.02 |
| P2:EA1 | 2:1 | 1.00 |
| P13 | — | 0.81 |
| P2 | — | 0.83 |
| B: Experiments with YC2 as above except with coupler solvent Ix. | | |
| P1:P13:S1 | 1:1:1 | 1.38 Check |
| P1:P13:EA1 | 1:1:1 | 1.43 |
| P1:P2:EA1 | 1:1:1 | 1.93 |
| P2:P13:EA1 | 1:1:1 | 1.75 |

TABLE 1-continued

Comparison of Stabilizers in TBC and Ix.

| Stabilizers | Stabilizer Ratio by Weight (Total Weight Constant @ 0.242 $g/m^2$) | T 0.3; Time to Fade to 0.3 loss from 1.0 (Ratio vs. Check) |
|---|---|---|
| P2:S1 | 2:1 | 1.70 |
| P2:EA1 | 2:1 | 1.90 |

Example 4

To demonstrate the structure space of useful electron rich aromatic compounds, various EA's were coated with YC2 and P2 in solvent Ii. Table 2 compares the previously patented stabilizer combination (P1/P13/S1) with various electron rich aromatic systems (EA). In this set, the phenol P2 and solvent Ii are held constant. As can be seen, all the EA's reported afford a better dye loss position (3wk HID) over that of the check.

TABLE 2

Variation of Electron Rich Aromatic Stabilizers (EA). Check is run using the conditions from U.S. Pat. No. 6,555,306. Yellow coupler used throughout the experiment is YC2.

| Phenol (P) | EA | Conc. of EA (ratio to coupler*) | Solvent | Dye loss 3 wk. (% loss from D = 1) |
|---|---|---|---|---|
| P1/P13/S1 | — | — | TBC | 25.6 (check) |
| P2 | EA1 | 1x | Ii | 10.4 |
| P2 | EA10 | 1x | Ii | 10.5 |
| P2 | EA12 | 1x | Ii | 9.4 |
| P2 | EA13 | 1x | Ii | 10.3 |
| P2 | EA3 | 2x | Ii | 9.0 |
| P2 | EA16 | 2x | Ii | 11.5 |
| P2 | EA15 | 2x | Ii | 11.4 |
| P2 | EA5 | 1x | Ii | 9.9 |
| P2 | EA2 | 2x | Ii | 9.5 |

*This based on number of phenol units in the EA stabilizer.

Example 5

Further EA structures were coated as in example 4. Table 3 reports additional electron rich stabilizers (EA) in combination with P2 and Ii. The check coating utilizing P1/ST1 was also coated in Ii. There is a very consistent light stability centered on the 6-alkoxychroman-ring system (EA2, 32, 31, 33, 34, and 36).

TABLE 3

Additional variations of Electron Rich Aromatic Stabilizers, EA's, coated with P2 and YC2 in coupler solvent Ii.

| P | EA* | Dye loss 3 wk. (% loss from D = 1) |
|---|---|---|
| P1 | (ST 1) | 17.6 (check/Ii) |
| P2 | EAl | 9.3 |
| P2 | EA2 | 12.4 |
| P2 | EA32 | 12.6 |
| P2 | EA31 | 12.7 |
| P2 | EA33 | 12.6 |
| P2 | EA34 | 12.9 |
| P2 | EA36 | 12.5 |
| P2 | EA38 | 12.8 |

* All EA's coated at equal molar amounts.

Example 6

To demonstrate the broadness of solvent structures, various solvents I were coated with P3 and P4. Table 4 reports the 3 week HID dye loss result after holding P3 or P4 and EA32 constant while varying the claimed solvents I. All solvents reported are considerably better than the check solvent, TBC, from a dye loss position.

TABLE 4

Various solvents (I) with P3 and P4 and EA32; coated with YC2.

| P | Solvent | Dye loss 3 wk. (% loss from D = 1) |
|---|---|---|
| P3 | Ii | 10.0 |
| P3 | Ix | 10.4 |
| P3 | Iz | 10.3 |
| P3 | Inn | 11.5 |
| P3 | Imm | 11.6 |
| P3 | Ipp | 9.9 |
| P3 | Iqq | 11.6 |
| P3 | Itt | 10.9 |
| P3 | Iss | 14.3 |
| P3 | TBC | 43.0 Check |
| P4 | Ii | 13.3 |
| P4 | Ix | 14.7 |
| P4 | Iz | 14.4 |
| P4 | Imm | 15.8 |
| P4 | Ipp | 13.7 |
| P4 | Itt | 16.3 |
| P4 | TBC | 50.1 Check |

Example 7

To demonstrate the scope of coupler structure on light stability, various couplers were coated in TBC and compared to Ii. Table 5 reports the 3 week HID dye loss results from various yellow couplers. In all cases, the utilization of the claimed solvent/stabilizer mixture affords a better dye loss position. Even in the cases of YC 26 and 27, which are extremely unstable toward light, an improvement is observed with Ii/P2/EA1.

TABLE 5

Light stability of various yellow couplers (YC) with P2 and EA1 in check solvent TBC and invention solvent Ii.

| YC | Solvent | Dye loss 3 wk. (% loss from D = 1) | |
|---|---|---|---|
| YC2 | TBC | 43.3 | TBC Checks |
| YC22 | TBC | 44.8 | |
| YC23 | TBC | 49.7 | |
| YC18 | TBC | 32.0 | |
| YC19 | TBC | 18.4 | |
| YC1 | TBC | 15.4 | |
| YC24 | TBC | 38.2 | |
| YC27 | TBC | 83.3 | |
| YC26 | TBC | 78.0 | |
| YC2 | Ii | 14.3 | |
| YC22 | Ii | 13.0 | |
| YC23 | Ii | 12.8 | |
| YC18 | Ii | 8.5 | |
| YC19 | Ii | 7.0 | |
| YC1 | Ii | 6.1 | |
| YC24 | Ii | 12.4 | |
| YC27 | Ii | 75.9 | |
| YC26 | Ii | 65.7 | |

Example 8

Table 6 reports further combinations of phenols, P, and electron rich aromatic systems, EA. As can be seen, the actual value of the light stability is dependent on which P and EA are combined, however, all combinations of P and EA are better than the check. The best results are with the combination of P2 and EA1 in this particular solvent, Ii.

TABLE 6

Variations of Electron Rich Aromatic Stabilizers (EA) and Phenols (P). Molar ratio of P to EA was 3.4 to 1. Yellow coupler used throughout the experiment was YC2.

| Phenol (P) | EA | Solvent | Dye loss 3 wk. (% loss from D = 1) |
|---|---|---|---|
| P1 | S1 | TBC | 23.6 (check) |
| P2 | EA1 | Ii | 9.2 |
| P2 | EA2 | Ii | 10.1 |
| P9 | EA1 | Ii | 13.6 |
| P9 | EA2 | Ii | 15.2 |
| P19 | EA1 | Ii | 14.4 |
| P19 | EA2 | Ii | 17.1 |

Example 9

Table 7 examines the most efficient ratio between the phenol, P, and the electron rich aromatic system, EA. It appears that the best light stability is afforded when there is an excess of P over EA. In this experiment the ratio can be seen to be between 1.58–2:1 with P2 and EA1. As would be expected, the actual amounts of the stabilizers are important; even if the 2:1 ratio is maintained under these conditions, the amounts of P and EA should not be dropped below 11.5 and 7.3 mg/ft$^2$ (124 and 78 mg/m$^2$) respectively. It is noticed that the bis-phenol P2 is more efficient than P13, also a molecule containing two phenols, again confirming that P2 is a preferred phenolic structure.

TABLE 7

Determination of efficent ratio between P and EA. Yellow couple is YC2 and solvent is Ii (37.72 mg/ft$^2$).

| P (mg/ft$^2$) | EA (mg/ft$^2$) | Ratio | Dye loss 3 wk. (%loss from D = 1) |
|---|---|---|---|
| P1 (7.3)/P13 (7.3) | S1 (7.3) | 1:1:1 | 28.6 |
| P2 (14.6) | EA1 (7.3) | 2:1 | 9.0 |
| P2 (11.5) | EA1 (5.7) | 2:1 | 9.9 |
| P2 (5.8) | EA1 (2.9) | 2:1 | 13.1 |
| P2 (2.9) | EA1 (1.4) | 2:1 | 19.2 |
| P2 (11.5) | EA1 (7.3) | 1.58:1 | 8.9 |
| P2 (11.5) | EA1 (2.9) | 4:1 | 10.4 |
| P2 (5.8) | EA1 (7.3) | 1:1.25 | 11.3 |
| P2 (2.9) | EA1 (7.3) | 1:2.52 | 13.9 |
| P2 (1.4) | EA1 (7.3) | 1:5.21 | 17.8 |
| P13 (36.4) | EA1 (7.3) | 5:1 | 11.7 |
| P13 (28.6) | EA1 (5.7) | 5:1 | 12.7 |
| P13 (7.1) | EA1 (1.4) | 5:1 | 18.5 |
| P13 (28.6) | EA1 (7.3) | 4:1 | 11.4 |
| P13 (28.6) | EA1 (5.7) | 5:1 | 11.3 |
| P13 (28.6) | EA1 (2.9) | 9.9:1 | 12.8 |
| P13 (14.3) | EA1 (7.3) | 2:1 | 11.3 |
| P13 (7.1) | EA1 (7.3) | 1:1.03 | 14.0 |
| P13 (3.6) | EA1 (7.3) | 1:2 | 17.9 |

Example 10

Coupler solvent Ii has a pronounced effect on light stability even when utilized in a mixture with TBC. Table 8 show that a mixture of 1:2, TBC to Ii, still retains its light stabilizing properties (last two entries in table 8). This is an advantage since the very cheap TBC could be used to lower the cost of the total coupler solvent required.

TABLE 8

Mixtures of TBC and Ii and its effect on dye loss. Yellow coupler is YC2. Ratio of YC2 to stabilizer mixture is 1.7:1 by weight.

| P* | ST | EA | Solvent (I)** | Dye loss 3 wk. (% loss from D = 1) |
|---|---|---|---|---|
| 1. P1 | S1 | — | TBC | 25.9 (standard check) |
| 2. P1 | S1 | — | TBC/Ii | 16.3 |
| 3. P1 | — | EA1 | TBC/Ii | 15.1 |
| 4. P2 | S1 | — | TBC | 33.8 |
| 5. P2 | — | EA1 | TBC | 32.5 |
| 6. P2 | — | EA1 | Ii | 12.3 |
| 7. P2 | — | EA1 | TBC/Ii | 11.7 |

*Ratios of stabilizers, P:ST is 2:1; P:EA is 2:1.
**Ratios of coupler solvent mixtures is 1:2, TBC:Ii.

Example 11

In an experiment similar to that of example 10 above, 1:1 weight mixtures of TBC and Ii were examined. In table 9 it can be seen that at this mixture ratio light stability begins to be affected negatively. At all three levels of P2/EA1, the light stability of the 1:1 solvent mixtures are worse than that of pure Ii. As can be seen from tables 8 and 9, quantities of P and EA can be combined with various mixtures of Ii and TBC to obtain an optimum light stability position verses cost.

TABLE 9

A study of the amounts of stabilizers (EA1/P2) vs. the amounts of coupler solvents (TBC/Ii). Yellow coupler is YC2 (37.72 mg/ft$^2$).

| P2 (mg/ft$^2$) | EA1 (mg/ft$^2$) | TBC (mg/ft$^2$) | Ii (mg/ft$^2$) | Dye loss 3 wk. (% loss from D = 1) | |
|---|---|---|---|---|---|
| 14.65 | 7.32 | 19.83 | — | 44.8 | Check |
| 14.65 | 7.32 | — | 10.38 | 19.6 | |
| 14.65 | 7.32 | — | 20.38 | 15.3 | |
| 14.65 | 7.32 | — | 30.38 | 12.9 | |
| 10.67 | 5.33 | — | 13.83 | 17.4 | |
| 10.67 | 5.33 | — | 23.83 | 14.5 | pure Ii |
| 10.67 | 5.33 | — | 33.83 | 13.1 | |
| 6.67 | 3.33 | — | 17.28 | 18.3 | |
| 6.67 | 3.33 | — | 27.28 | 17.1 | |
| 6.67 | 3.33 | — | 37.28 | 17.0 | |
| 14.65 | 7.32 | 5.19 | 5.19 | 22.4 | |
| 14.65 | 7.32 | 10.17 | 10.17 | 21.4 | |
| 14.65 | 7.32 | 15.19 | 15.19 | 19.7 | |
| 10.65 | 5.33 | 6.92 | 6.92 | 22.6 | |
| 10.65 | 5.33 | 11.92 | 11.92 | 21.7 | solvent mixture |
| 10.65 | 5.33 | 16.92 | 16.92 | 22.0 | |
| 6.67 | 3.33 | 8.64 | 8.64 | 24.6 | |
| 6.67 | 3.33 | 13.64 | 13.64 | 23.9 | |
| 6.67 | 3.33 | 18.64 | 18.64 | 76.0 | |

Example 12

To demonstrate the reduction insensitivity to UV light with formula of this invention, the coatings in table 10 below were submitted for HID testing with two different levels of UV absorber protection, 0.48 g/m$^2$ and 0.30 g/m$^2$. The time to fade 0.2 from a density of 1.0 (T 02) was calculated for each set of coatings, and the % degradation in this time between the high and low levels of UV protection was calculated.

The results show that replacement of TBC with a solvent of this invention significantly improves the light fade performance at the lower UV level. Additionally including the stabilizers of this invention shows a still further improvement in performance. This benefit would enable a reduction in coated UV absorber level which would lower manufacturing cost and also reduce the yellow Dmin associated with UV absorbers.

TABLE 10

Effect of lowering UV protection. Solvents were coated at 0.53x vs. weight of coupler YC2 in this experiment.

| Stabilizers | Stabilizer Ratio by Weight (Total Weight Constant @ 0.242 g/m$^2$) | Solvent | % Degradation in T 02 between high and low UV levels. |
|---|---|---|---|
| P1:P13:S1 (check) | 1:1:1 | TBC | 23.6 Check |
| P1:P13:S1 (check) | 1:1:1 | Ii | 15.8 Check |
| P2:EA1 | 2:1 | Ii | 12.5 Inv |

The invention has been described by reference to preferred embodiment, but it will be understood changes can be made to the embodiments specifically described herein within the spirit and scope of the invention. The patents and other publications referred to herein are incorporated by reference.

The invention claimed is:

1. A photographic element comprising a silver halide emulsion layer having associated therewith a dye forming coupler and a combination of:

A. a coupler solvent compound of the following Formula I:

$$R^1R^2N—C(O)—(R)_p—C(O)—NR^3R^4 \quad (I)$$

wherein:

R represents a non-aromatic hydrocarbon-linking group;

p is 0 or 1;

$R^1$, $R^2$, $R^3$ and $R^4$ are independently selected substituent groups;

B. a phenolic antioxidant compound of Formula P:

(P)

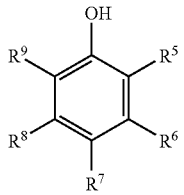

wherein:

$R^5$, $R^6$, $R^7$, $R^8$ and $R^9$ are independently hydrogen or substituent groups; and C. an electron-rich aromatic compound of Formula EA:

(EA)

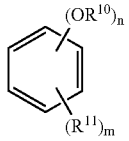

wherein:

each $R^{10}$ is a substituent group;

each $R^{11}$ is hydrogen or an independently selected substituent group; and n is 2 to 6 and m is 0 to 4; provided that the total of n+m is not larger than 6.

2. An element according to claim 1, wherein compound of Formula EA is a multifunctional compound represented by:

EA—X—EA' wherein each or EA and EA' are independently selected in accordance with claim 1; and X is a linking moiety.

3. An element according to claim 2, wherein the compound of Formula P is represented by:

P—L—P' wherein:

each of P and P' are independently selected fom Formula (P):

(P)

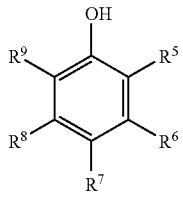

wherein:

$R^5$, $R^6$, $R^7$, $R^8$ and $R^9$ are independently hydrogen or substituent groups; and L is a linking moiety.

4. An element according to claim 1 wherein the weight ratio of compound P to EA is greater than 1.

5. An element according to claim 1 wherein the weight ratio of compound P to EA is between 1.5:1 and 3.5:1.

6. An element according to claim 1 wherein the laydown of compound P is at least 124 mg/m$^2$.

7. An element according to claim 1 wherein the laydown of compound EA is at least 78 mg/m$^2$.

8. An element according to claim 1, wherein the molar ratio of compound of formula I to coupler is from 0.05:1 to 4.0:1.

9. An element according to claim 8, wherein the molar ratio of compound of formula I to compound P is from 01.12:1 to 25.0:1, provided the molar amounts of P are multiplied in the case of a multifunctional compound.

10. An element according to claim 1, wherein the molar ratio of compound of formula I to coupler is from 0.01:1 to 2.5:1.

11. An element according to claim 1, wherein the molar ratio of total permanent solvent, including compound of formula I, to coupler is from 0.05:1 to 4.0:1.

12. An element according to claim 1, wherein the dye-forming coupler comprises an acetanilide-based yellow dye-forming coupler.

13. An element according to claim 12, wherein the yellow coupler is of the formula

YELLOW-1

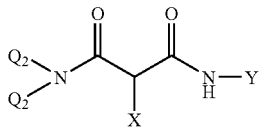

YELLOW-2

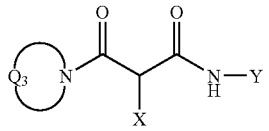

YELLOW-3

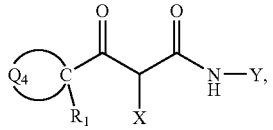

or

YELLOW -4

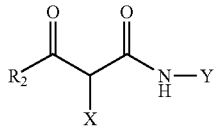

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring.

14. An element according to claim 12, wherein the yellow coupler is of the formula YELLOW-4 where $R_2$ represents an aryl or alkyl group and Y represents an aryl group.

15. An element according to claim 12 wherein the yellow coupler is of formula:

YELLOW-5

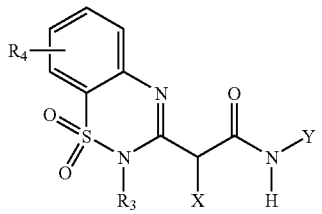

wherein $R_3$ and $R_4$ each represent a substituent; X is hydrogen or a coupling-off group; and Y represents an aryl group or a heterocyclic group.

16. An element according to claim 1, comprising a color paper photographic element that comprises a reflective support.

17. An element according to claim 1, wherein the compound of formula I is employed in an amount of from 0.1 to 5.0 mg/mg yellow coupler.

* * * * *